US011014643B2

(12) United States Patent
Myers et al.

(10) Patent No.: US 11,014,643 B2
(45) **Date of Patent: *May 25, 2021**

(54) STEERING MECHANISM FOR A BOAT HAVING A PLANING HULL

(71) Applicant: MasterCraft Boat Company, LLC, Vonore, TN (US)

(72) Inventors: Michael D. Myers, Knoxville, TN (US); Michael J. Uggeri, Knoxville, TN (US); David F. Ekern, Knoxville, TN (US); Matthew J. Huyge, Wyoming, MI (US)

(73) Assignee: MasterCraft Boat Company, LLC, Vonore, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/672,898

(22) Filed: Nov. 4, 2019

(65) Prior Publication Data

US 2020/0062367 A1 Feb. 27, 2020

Related U.S. Application Data

(63) Continuation of application No. 16/106,881, filed on Aug. 21, 2018, now Pat. No. 10,464,655, which is a (Continued)

(51) Int. Cl.
*B63H 25/38* (2006.01)
*B63H 25/10* (2006.01)
(Continued)

(52) U.S. Cl.
CPC ..... *B63H 25/38* (2013.01); *B63B 1/18* (2013.01); *B63B 34/00* (2020.02); *B63H 1/14* (2013.01);
(Continued)

(58) Field of Classification Search
CPC .. B63B 1/00; B63B 1/18; B63B 34/00; B63H 1/00; B63H 1/14; B63H 5/00;
(Continued)

(56) References Cited

U.S. PATENT DOCUMENTS 969,642 A 9/1910 Lund
1,327,643 A 1/1920 Tarn
(Continued)

FOREIGN PATENT DOCUMENTS

JP 61157492 A 7/1986

OTHER PUBLICATIONS

European Search Report dated Nov. 7, 2017, in European Patent Application No. 17160275.8-1751.
(Continued)

*Primary Examiner* — Lars A Olson
(74) *Attorney, Agent, or Firm* — Venable LLP

(57) ABSTRACT

A boat includes a planing hull, a propeller, a main rudder, and a pair of flanking rudders. The planing hull has port and starboard sides, a transom, a hull bottom, and a centerline running down the middle of the boat, halfway between the port and starboard sides. The propeller is positioned forward of the transom and beneath the hull bottom. The main rudder is positioned aft of the propeller. The main rudder has a rotation axis about which the main rudder rotates. The flanking rudders are positioned forward of the propeller. One of the flanking rudders is positioned on the port side of the centerline, and the other flanking rudder is positioned on the starboard side of the centerline.

20 Claims, 15 Drawing Sheets

Related U.S. Application Data continuation of application No. 15/477,862, filed on Apr. 3, 2017, now Pat. No. 10,065,725, which is a continuation of application No. 15/184,340, filed on Jun. 16, 2016, now Pat. No. 9,611,009.

(60) Provisional application No. 62/347,313, filed on Jun. 8, 2016.

(51) Int. Cl.

| | |
|---|---|
| ***B63H 25/30*** | (2006.01) |
| ***B63B 34/00*** | (2020.01) |
| ***B63B 1/18*** | (2006.01) |
| ***B63H 1/14*** | (2006.01) |
| ***B63H 5/125*** | (2006.01) |
| ***B63H 25/06*** | (2006.01) |
| ***B63H 5/07*** | (2006.01) |

(52) U.S. Cl.
CPC ..... *B63H 5/07* (2013.01); *B63H 5/125* (2013.01); *B63H 25/06* (2013.01); *B63H 25/10* (2013.01); *B63H 25/30* (2013.01); *B63H 2025/063* (2013.01); *B63H 2025/066* (2013.01); *B63H 2025/387* (2013.01)

(58) Field of Classification Search
CPC ..... B63H 5/125; B63H 25/00; B63H 25/06; B63H 25/38; B63H 25/42; B63H 5/07; B63H 25/10; B63H 25/30
USPC ..... 114/162, 163; 440/51
See application file for complete search history.

(56) References Cited

U.S. PATENT DOCUMENTS

| | | | |
|---|---|---|---|
| 1,561,142 | A | 11/1925 | Elsey |
| 1,717,286 | A | 6/1929 | Ward |
| 2,251,133 | A | 7/1941 | Horstman |
| 2,851,001 | A | 9/1958 | Scott |
| 2,996,031 | A | 8/1961 | Easter |
| 3,009,435 | A | 11/1961 | Horton, Jr. |
| 3,101,693 | A | 8/1963 | Schilling |
| 3,200,783 | A | 8/1965 | Winter |
| 3,237,586 | A | 3/1966 | Stuteville |
| 3,407,774 | A | 10/1968 | Burke |
| 3,710,749 | A | 1/1973 | Duryea |
| 3,872,817 | A | 3/1975 | Duryea |
| 4,031,846 | A | 6/1977 | Tone |
| 4,085,694 | A | 4/1978 | Schilling et al. |
| 5,359,956 | A | 11/1994 | Lee |
| 5,445,100 | A | 8/1995 | Finkl |
| 5,488,919 | A | 2/1996 | Ferreiro et al. |
| 6,178,907 | B1 | 1/2001 | Shirah et al. |
| 6,827,031 | B2 | 12/2004 | Aoyama |
| 7,128,011 | B2 | 10/2006 | Altland et al. |
| 7,316,194 | B1 | 1/2008 | Shen et al. |
| 7,895,959 | B1 | 3/2011 | Angel et al. |
| 8,397,656 | B1 | 3/2013 | Purdy et al. |
| 8,534,214 | B1 | 9/2013 | Gasper |
| 8,578,873 | B2 | 11/2013 | Gasper et al. |
| 9,611,009 | B1 | 4/2017 | Myers et al. |
| 10,065,725 | B2 | 9/2018 | Myers et al. |
| 10,464,655 | B2 * | 11/2019 | Myers ..... B63H 25/06 |

OTHER PUBLICATIONS

Examination Report No. 1 for Standard Patent Application in Australian Patent Application No. 2017202146, dated May 3, 2017.

* cited by examiner

STEERING MECHANISM FOR A BOAT HAVING A PLANING HULL

CROSS REFERENCE TO RELATED APPLICATION

This application is a continuation of U.S. patent application Ser. No. 16/106,881, filed Aug. 21, 2018, now U.S. Pat. No. 10,464,655. U.S. patent application Ser. No. 16/106,881 is a continuation of U.S. patent application Ser. No. 15/477,862, filed Apr. 3, 2017, now U.S. Pat. No. 10,065,725. U.S. patent application Ser. No. 15/477,862 is a continuation of U.S. patent application Ser. No. 15/184,340, filed Jun. 16, 2016, now U.S. Pat. No. 9,611,009. U.S. patent application Ser. No. 15/184,340 claims the benefit under 35 U.S.C. § 119(e) of U.S. Provisional Patent Application No. 62/347,313, filed Jun. 8, 2016, and titled "Steering Mechanism for a Boat having a Planning Hull." The forgoing applications are incorporated herein by reference in their entireties.

FIELD OF THE INVENTION

This invention relates to a steering mechanism for a boat having a planing hull.

BACKGROUND OF THE INVENTION

Water sports, such as water skiing and wakeboarding, are typically performed at high speeds, and many recreational sport boats used for these sports have planing hulls, which are designed for efficient high-speed operation. In addition, many of these recreational sport boats are also inboards, having a propeller positioned beneath the hull, forward of the transom. This configuration is generally safer for water sports, as compared to outboards or stemdrives, for example, where the propeller extends behind the transom of the boat. But inboards, which typically have a single rudder positioned behind a stationary propeller, may be more difficult to handle, particularly in reverse, than an outboard where the propeller turns along with the motor when the boat turns. In reverse, inboards have a tendency to pull in one direction even if the rudder is turned hard over to turn the boat the other way. There is thus desired a planing hull boat with an inboard motor having improved handling characteristics.

SUMMARY OF THE INVENTION

In one aspect, the invention relates to a boat including a planing hull, a propeller, a main rudder, and a pair of flanking rudders. The planing hull has port and starboard sides, a transom, a hull bottom, and a centerline running down the middle of the boat, halfway between the port and starboard sides. The propeller is positioned forward of the transom and beneath the hull bottom. The main rudder is positioned aft of the propeller. The main rudder has a rotation axis about which the main rudder rotates. The flanking rudders are positioned forward of the propeller. One of the flanking rudders is positioned on the port side of the centerline, and the other flanking rudder is positioned on the starboard side of the centerline. Each flanking rudder has a rotation axis about which that flanking rudder rotates.

In another aspect, the invention relates to a boat including a planing hull, a propeller, a main rudder, and a pair of flanking rudders. The planing hull has port and starboard sides, a transom, a hull bottom, and a centerline running down the middle of the boat, halfway between the port and starboard sides. The propeller is positioned forward of the transom and beneath the hull bottom. The main rudder is positioned aft of the propeller. The main rudder has a rotation axis about which the main rudder rotates. The flanking rudders are positioned forward of the propeller. One of the flanking rudders is positioned on the port side of the centerline, and the other flanking rudder is positioned on the starboard side of the centerline. Each flanking rudder has an aft edge and a rotation axis about which that flanking rudder rotates. When the aft edge of each flanking rudder is rotated to port, the starboard flanking rudder is configured to rotate at a rotation rate that is different than a rotation rate at which the port flanking rudder is configured to rotate. When the aft edge of each flanking rudder is rotated to starboard, the port flanking rudder is configured to rotate at a rotation rate that is different than a rotation rate at which the starboard flanking rudder is configured to rotate.

In a further aspect, the invention relates to a boat including a planing hull, a propeller, a main rudder, a pair of flanking rudders, at least one actuator and a controller. The planing hull has port and starboard sides, a transom, a hull bottom, and a centerline running down the middle of the boat, halfway between the port and starboard sides. The propeller is positioned forward of the transom and beneath the hull bottom. The main rudder is positioned aft of the propeller. The main rudder has a rotation axis about which the main rudder rotates. The flanking rudders are positioned forward of the propeller. One of the flanking rudders is positioned on the port side of the centerline, and the other flanking rudder is positioned on the starboard side of the centerline. Each of the flanking rudders has (i) a rotation axis about which that flanking rudder rotates, (ii) a neutral position, and (iii) a forward edge that has an angle of toe in the neutral position. The at least one actuator is configured to rotate each flanking rudder about its rotation axis and change the angle of toe. The controller is configured to actuate the at least one actuator and change the angle of toe.

In still another aspect, the invention relates to a boat including a planing hull, a propeller, a main rudder, and a flanking rudder. The planing hull has port and starboard sides, a transom, a hull bottom, and a centerline running down the middle of the boat, halfway between the port and starboard sides. The propeller is positioned forward of the transom and beneath the hull bottom. The main rudder is positioned aft of the propeller. The flanking rudder is positioned forward of the propeller and offset from the centerline.

These and other aspects of the invention will become apparent from the following disclosure.

DETAILED DESCRIPTION OF THE PREFERRED EMBODIMENTS

Figure 1:
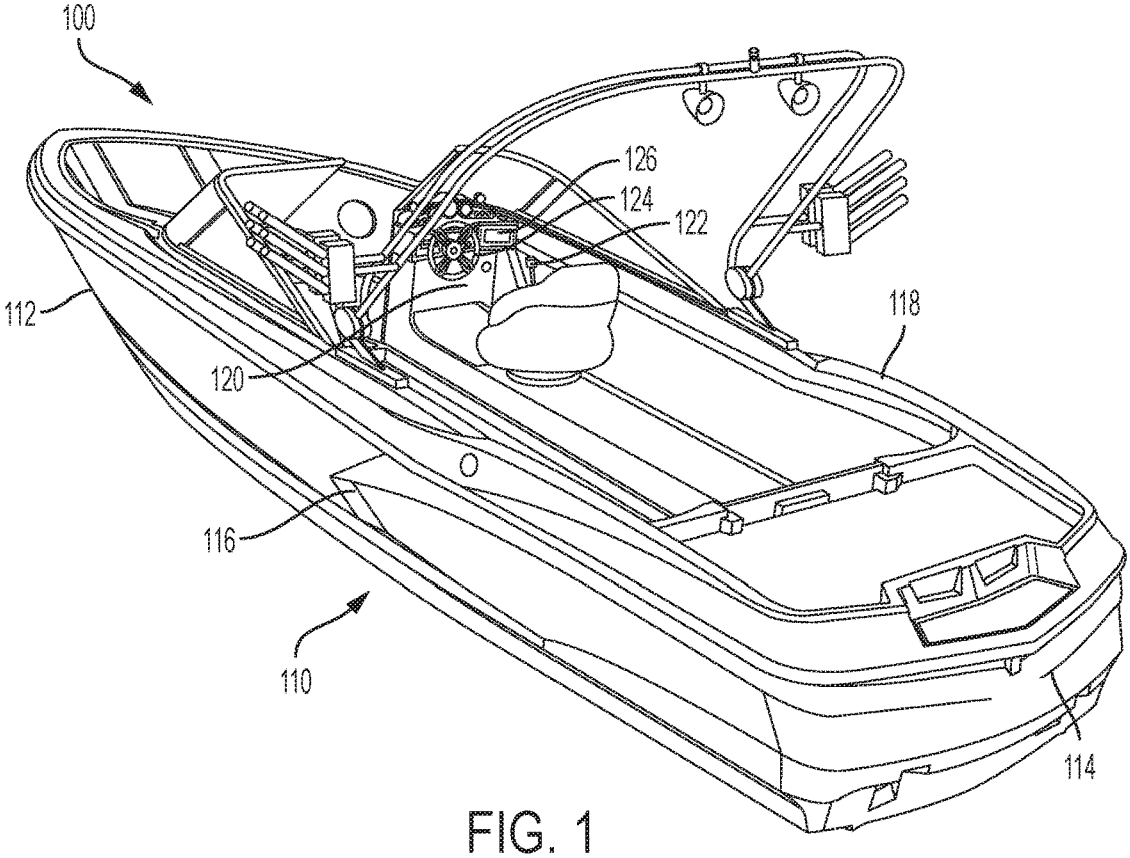
FIG. 1 shows a boat according to a preferred embodiment of the invention.
Figure 2:
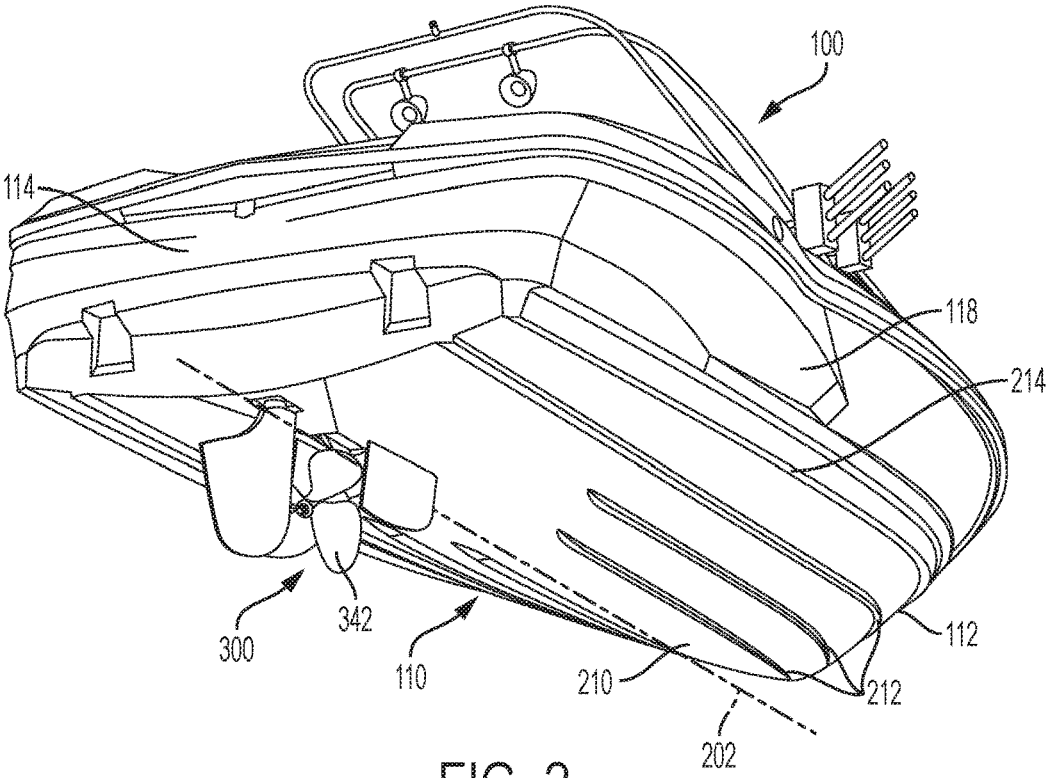
FIG. 2 is a bottom view of the boat shown in FIG. 1.

FIGS. 1 and 2 show a boat 100 in accordance with an exemplary preferred embodiment of the invention. The boat 100 includes a hull 110 with a bow 112, a transom 114, a port side 116, and a starboard side 118. FIG. 1 is a perspective view of the boat 100 from above, and FIG. 2 is a perspective view of the boat 100 from below showing a bottom 210 of the hull 110. The boat 100 has a centerline 202 running down the middle of the boat 100, halfway between the port and starboard sides 116, 118.

The hull 110 is a planing hull. When planing hull boats reach a certain speed, the resistance of the hull dramatically drops as the boat is supported by hydrodynamic forces instead of hydrostatic (buoyant) forces. This is referred to as planing. To achieve planing, the boat must overcome the drag produced by the hull and any appendages, such as the propeller and rudders. Appendages increase the drag of the hull. In general, the more appendages there are, the greater the drag. Some characteristics of the hull 110 that are typical of planing hull boats include lifting strakes 212, a chine 214 that is a hard chine, and a deadrise from 0° to 30°.

Figure 3:
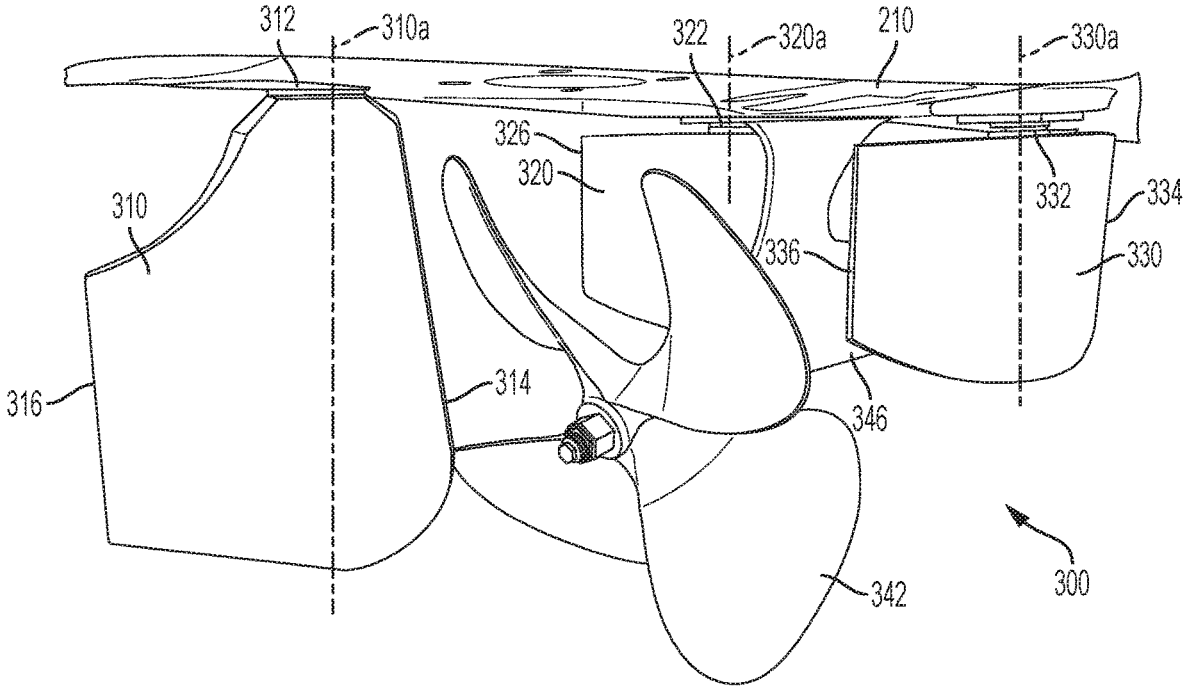
FIG. 3 is a detailed perspective view of a rudder assembly and section of a hull for the boat shown in FIGS. 1 and 2.
Figure 4:
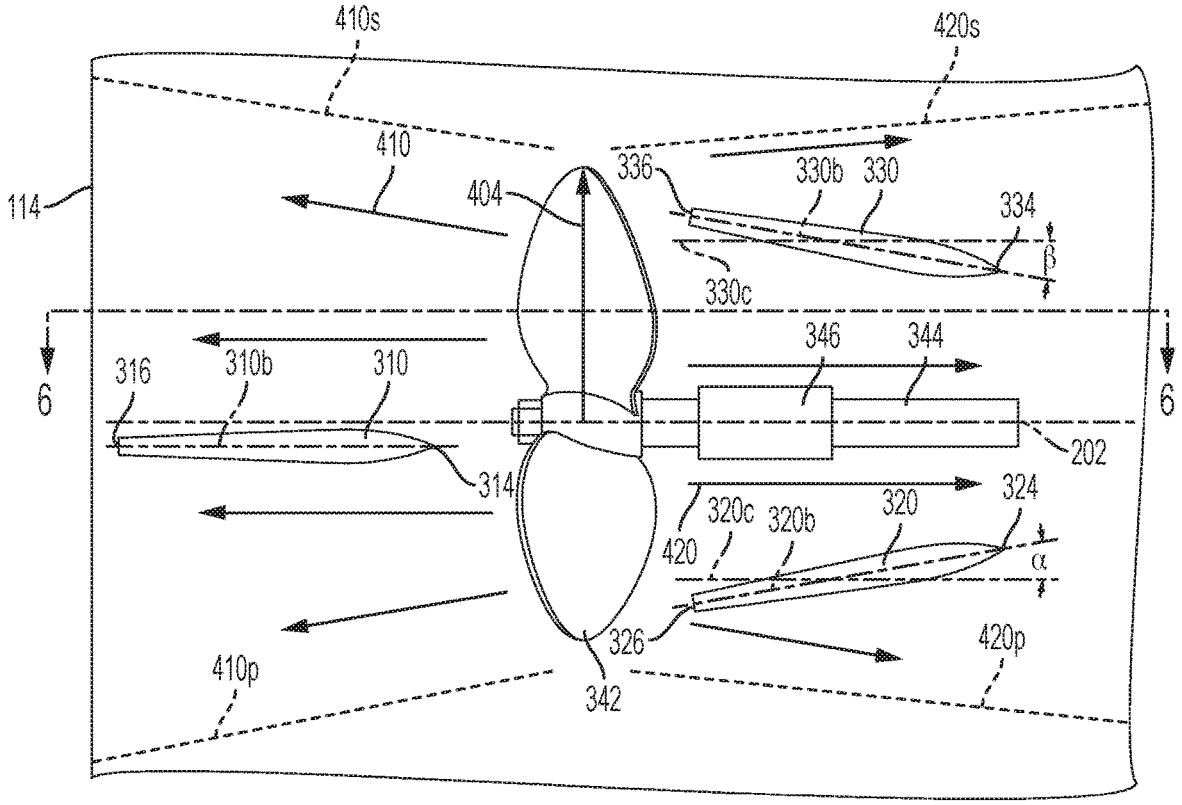
FIG. 4 is a bottom view of the rudder assembly and section of the hull shown in FIG. 3.
Figure 5:
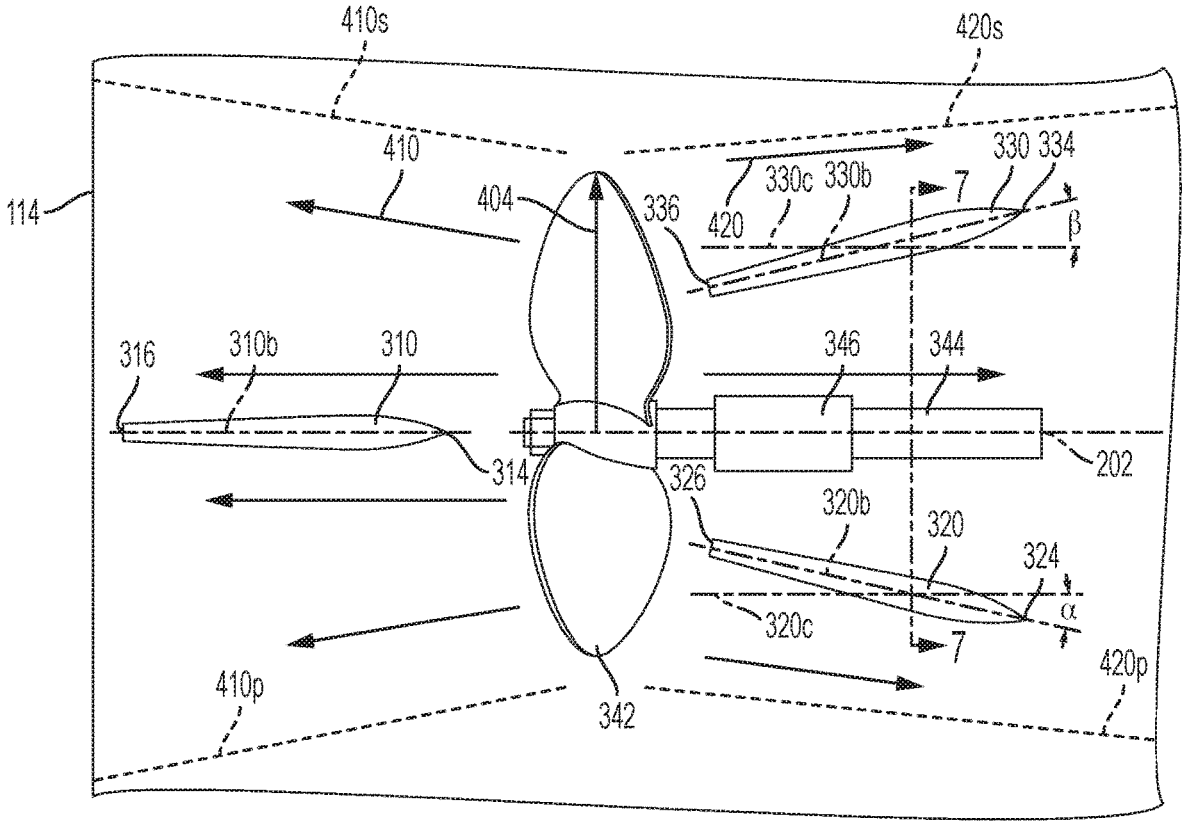
FIG. 5 is a bottom view of an alternate configuration of the rudder assembly and section of the hull shown in FIG. 3.
Figure 6:
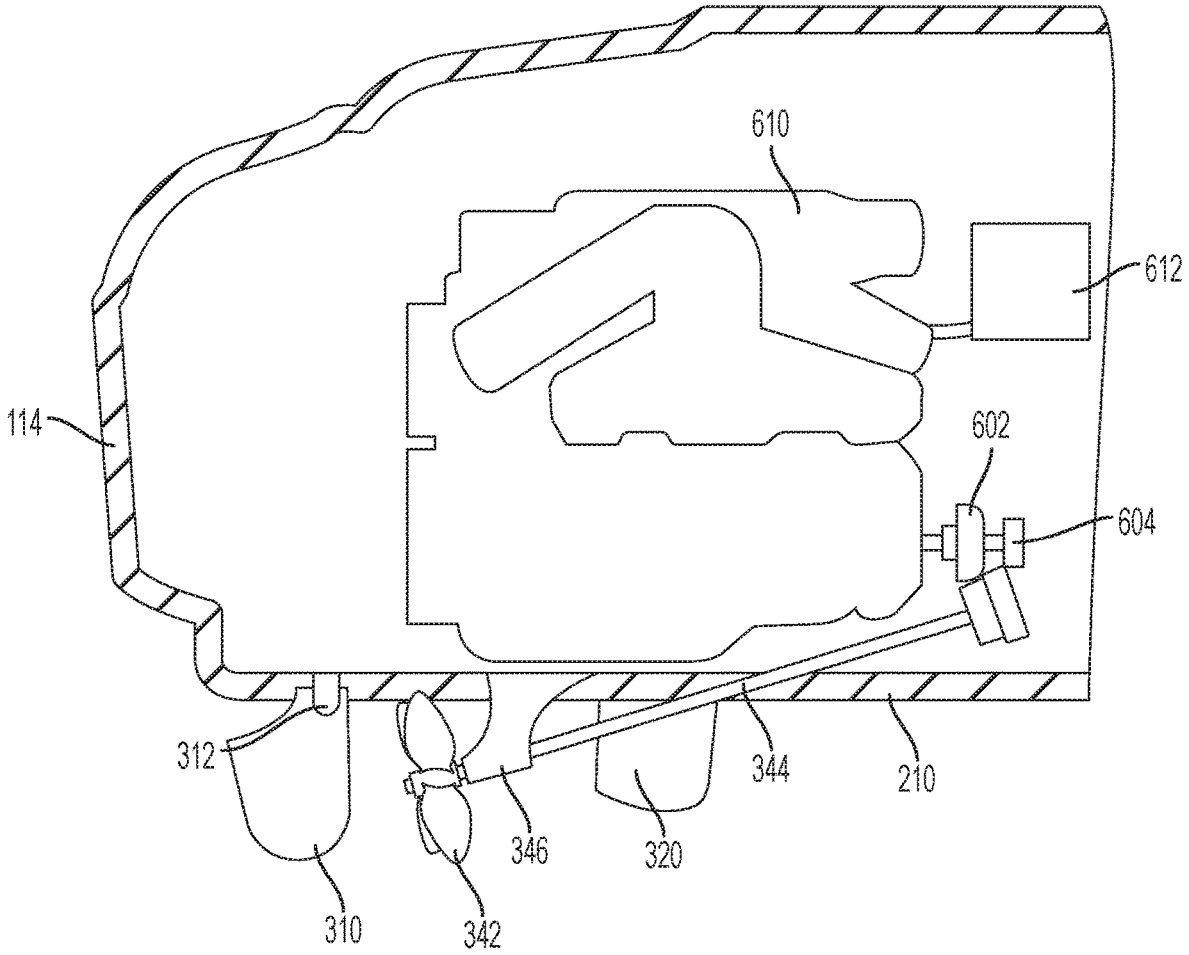
FIG. 6 is a cross-sectional view of the boat of FIGS. 1 and 2 taken along section line 6-6 in FIG. 4.

The boat 100 shown in FIGS. 1 and 2 is driven through the water by a single inboard motor and turned by a rudder assembly 300. FIG. 3 is a detailed perspective view of the rudder assembly 300. FIG. 4 is a bottom view of the section of the hull 110 shown in FIG. 3. FIG. 5 is a bottom view of the section of the hull 110 shown in FIG. 3, showing an alternate configuration of the rudder assembly 300. FIG. 6 is a cross-sectional view of the boat 100 taken along section line 5-5 in FIG. 4.

The inboard motor includes an engine 610 (see FIG. 6) connected to a propeller 342 by a drive shaft 344. A strut 346 extends from the hull bottom 210 to support the drive shaft 344 and thus the propeller 342. The drive shaft 344 extends through a bushing in the strut 346. The propeller 342 is positioned beneath the hull bottom 210 and forward of the transom 114. In this embodiment, the drive shaft 344, when viewed from below the boat 100 (e.g., FIG. 4) or above the boat 100, is aligned with the centerline 202 of the boat 100.

Also in this embodiment, the propeller 342 is a left-handed propeller, but any suitable propeller, including a right-handed propeller, may be used. The propeller 342 has a propeller radius 404 and a corresponding propeller diameter. Suitable propellers include propellers with a diameter from 12 inches to 18 inches. The propeller 342 accelerates a stream of water both in the forward and reverse directions, depending on its direction of rotation. As the propeller 342 rotates in the counterclockwise direction when viewed from the stern, the boat 100 moves forward, and the propeller 342 generates a forward race 410, which is an accelerated a stream of water. The forward race 410 has outer edges, shown generally between line 410*p* and line 410*s* in FIG. 4 when viewed from above or below the boat 100. Likewise, when the propeller 342 rotates in the clockwise direction, the boat 100 moves in reverse, and the propeller 342 generates a reverse race 420. The reverse race 420 has outer edges, shown generally between line 420*p* and line 420*s* in FIG. 4 when viewed from above or below the boat 100.

In this embodiment, the engine 610 and the propeller 342 may be operated by a user at a control console 120 (see FIG. 1). The control console 120 may include a control lever 122 (see FIG. 1) to operate a throttle 612 of the engine 610 and engage the engine 610 with the drive shaft 344. The control lever 122 has a neutral position, and the user may move the control lever 122 forward from the neutral position to engage a running gear 602 with the drive shaft 344, accelerate the engine 610 using the throttle 612, and rotate the propeller 342 counterclockwise to drive the boat 100 forward. To move the boat 100 in reverse, the user may move the control lever 122 back from the neutral position to engage a reverse gear 604 with the drive shaft 344, accelerate the engine 610 using the throttle 612, and rotate the propeller 342 clockwise. Any suitable means known in the art may be used to operate the engine 610 and engage it with the drive shaft 344.

The rudder assembly 300 includes three rudders: a main rudder 310 and a pair of flanking rudders 320, 330. The main rudder 310 includes a main rudder post 312 (better seen in FIG. 8A) that extends through the hull bottom 210 and is used to rotate the main rudder 310. The main rudder 310 rotates about a rotation axis 310*a*, which extends through the center of the main rudder post 312. The main rudder 310 has a forward edge 314 and an aft edge 316.

The main rudder 310 is positioned behind (aft) of the propeller 342 and preferably is positioned laterally within the outer edges 410*p*, 410*s* of the forward race 410. The main rudder post 312 may be positioned on the centerline 202 of the boat 100, when viewed from above (see FIG. 4), but in some instances, it may be preferable to offset the main rudder post 312 to one side of the centerline of the boat 100 (see FIG. 5). The main rudder post 312 is preferably offset far enough to facilitate removal of the drive shaft 344 without removing the main rudder 310. In some instances, the main rudder post 312 may be offset from the centerline 202 by up to the diameter of the drive shaft 344. For example, if the drive shaft 334 has a diameter of 1.125 inches, the main rudder post 312 may be offset from the centerline 202 by 1.125 inches, but it may also be offset by a value less than 1.125 inches, such as from 0.75 inch to 0.875 inch. Preferably, the main rudder post 312 is positioned forward of the transom, but other suitable locations, including on the transom, are contemplated to be within the scope of the invention.

The neutral position of a rudder 310, 320, 330 is its position when the boat 100 is moving straight and not turning. In this embodiment, when the main rudder 310 is in its neutral position, the chord 310*b* of the main rudder 310 is parallel to the centerline 202 of the boat 100 when viewed from above or below the boat 100. In embodiments where the main rudder post 312 is positioned on the centerline 202 of the boat 100, the chord 310*b* is preferably aligned with the centerline 202.

The flanking rudders 320, 330 are positioned forward of the propeller 342. One of the flanking rudders 320 is positioned on the port side of the centerline 202 of the boat 100, and the other flanking rudder 330 is positioned on the starboard side of the centerline 202 of the boat 100. Each flanking rudder 320, 330 includes a flanking rudder post 322, 332 (better seen in FIGS. 7A and 7B) that extends through the hull bottom 210 and is used to rotate the respective flanking rudder 320, 330. Each flanking rudder 320, 330 rotates about a rotation axis 320*a*, 330*a*, which extends through the center of the corresponding flanking rudder post 322, 332. Each flanking rudder 320, 330 includes a forward edge 324, 334 and an aft edge 326, 336.

Preferably, the flanking rudders 320, 330 are positioned to intersect the reverse race 420 when rotated from their neutral positions. More preferably, the flanking rudder posts 322, 332 are laterally positioned within the outer edges 420*p*, 420*s* of the reverse race 420, and even more preferably, within the radius 404 of the propeller 342. Preferably, both flanking rudders 320, 330 are symmetrical to each other. The posts 322, 332 of each flanking rudder 320, 330 are thus preferably located the same distance from the centerline 202 of the boat 100 and preferably positioned the same distance forward of the propeller 342. The flanking rudders 320, 330 are also preferably located close to the propeller 342 because the speed of the water and the lifting force of the reverse race dissipates the farther forward from the propeller 342 the flanking rudders 320, 330 are positioned. The flanking rudders 320, 330 are preferably positioned a distance forward of the propeller 342 that is equal to or less than three times the diameter of the propeller 342, more preferably a distance equal to or less than two times the diameter of the propeller 342, and even more preferably a distance equal to or less than the diameter of the propeller 342.

The neutral position of the flanking rudders 320, 330 is preferably set to balance the rudder load and drag to create a neutral feel in steering at all speeds. For some boats 100, the chord 320*b*, 330*b* of each flanking rudder 320, 330 is parallel to the centerline 202 in the neutral position. In other boats 100, the inventors have surprisingly found that the neutral position of the flanking rudders 320, 330 should be either toed-in or toed-out, relative to the forward direction of the boat 100. In a toed-in configuration (shown in FIG. 4) the forward edge 324, 334 of each flanking rudder 320, 330 is angled inboard with an angle of toe α, β measured from a line 320*c*, 330*c* that intersects the rotation axis 320*a*, 330*a* and is parallel to the centerline 202 of the boat 100, instead of being parallel to the centerline 202 of the boat 100. In a toed-out configuration (shown in FIG. 5) the forward edge 324, 334 of each flanking rudder 320, 330 is angled outboard with the angle of toe α, β. In this embodiment, the chord 320*b*, 330*b* of each flanking rudder 320, 330 is toed-in or out at the same angle of toe α, β from line 320*c*, 330*c*.

The inventors have found that the angles of toe α, β are preferably greater than 0° and less than 10°, and more preferably greater than 0° and less than 5°. As discussed above, the flanking rudders 320, 330 are preferably symmetrical about the centerline 202 and thus the angle of toe α of the port flanking rudder 320 is preferably the same as the angle of toe 13 of the starboard flanking rudder 330. One way of finding the neutral position for each flanking rudder 320, 330 is to disconnect the flanking rudders 320, 330 from their respective turning mechanisms and allow the flanking rudders 320, 330 to align naturally with the flow of water when the boat 100 is operated forward through the water at speed, for example from 5 mph to 50 mph.

Figure 7A:
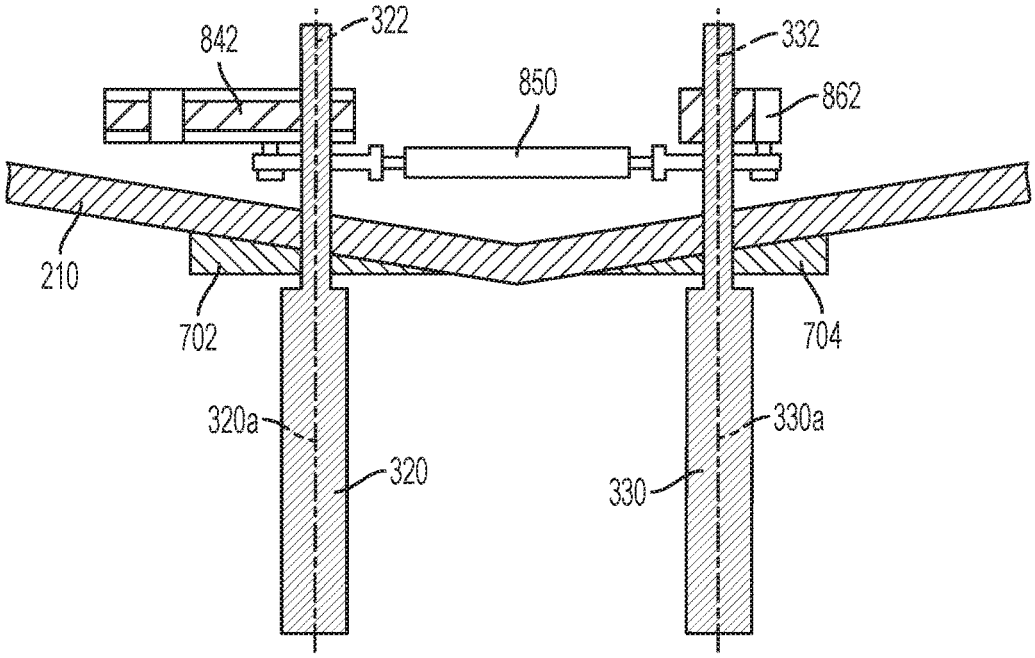
FIG. 7A is a cross-sectional view of the flanking rudders taken along line 7-7 in FIG. 5.
Figure 7B:
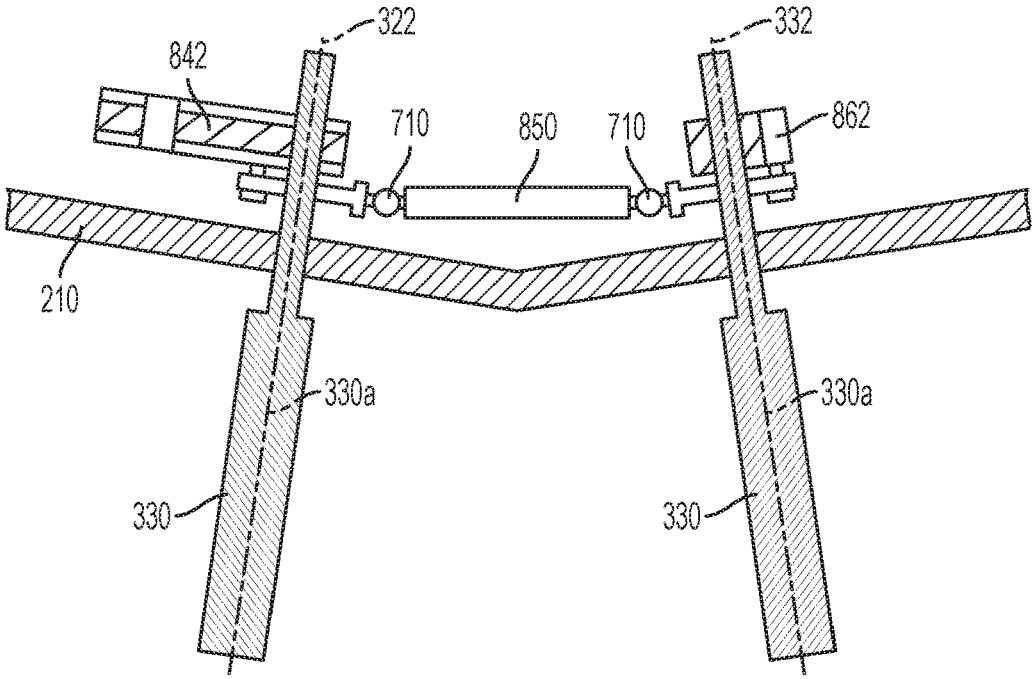
FIG. 7B is a cross-sectional view of an alternate configuration of the flanking rudders taken along line 7-7 in FIG. 5.

FIG. 7A is a cross-section taken along line 7-7 in FIG. 5 (the drive shaft 344, engine 610 and associated components, and first linkage 830 (discussed further below) have been omitted from this view for clarity). Note, FIG. 7A is applicable to any of the angles of toe α, β discussed herein (e.g., FIG. 4). In the preferred embodiment, shown in FIG. 7A the flanking rudders 320, 330 and corresponding flanking rudder posts 322, 332 are oriented vertically. To assist in achieving this orientation, a structural supports 702, 704 are positioned along the hull bottom 210. These structural supports 702, 704 have the shape of a wedge to assist in orienting the flanking rudders 320, 330 vertically. Although shown as pieces separate from the hull bottom 210, those skilled in the art will recognize that the structural supports 702, 704 may be formed integrally with the hull bottom. Alternatively, the flanking rudders 320, 330 and corresponding flanking rudder posts 322, 332 may be oriented perpendicular to the hull bottom 210 (i.e., orientated perpendicular to the dead rise), as shown in FIG. 7B. In the alternative orientation shown in FIG. 7B, the linkages (e.g., 850) and/or tiller arms (e.g., 842, 844, 862), discussed further below with reference to FIGS. 8, 9, and 10, may include features such as joints 710 to account for the angled flanking rudder posts 322, 332. A suitable joint 710 may include, for example, heim joints.

Figure 9:
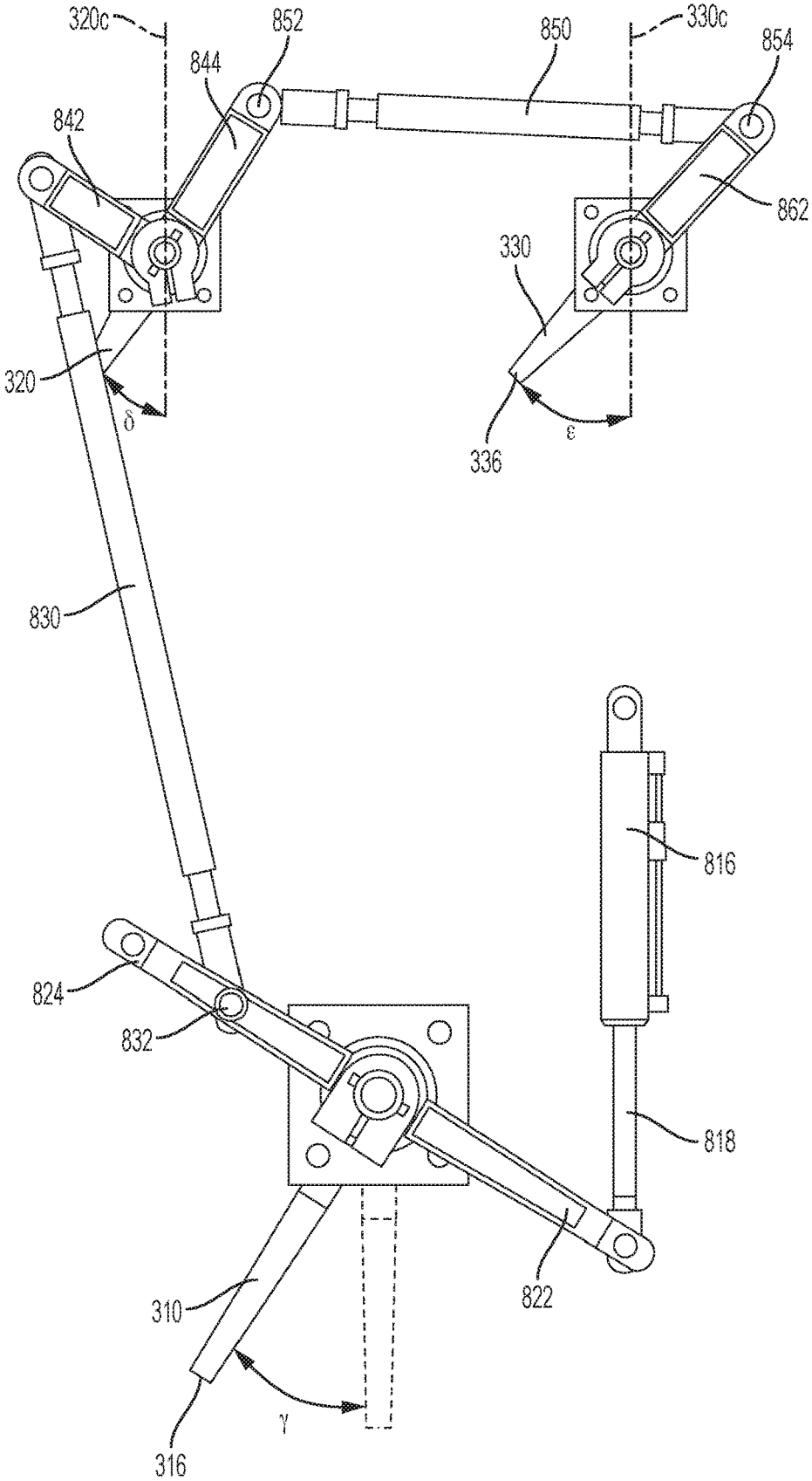
FIG. 9 is the top view of the rudder assembly shown in FIG. 8A in a position for a turn to port when the boat is moving forward.
Figure 10:
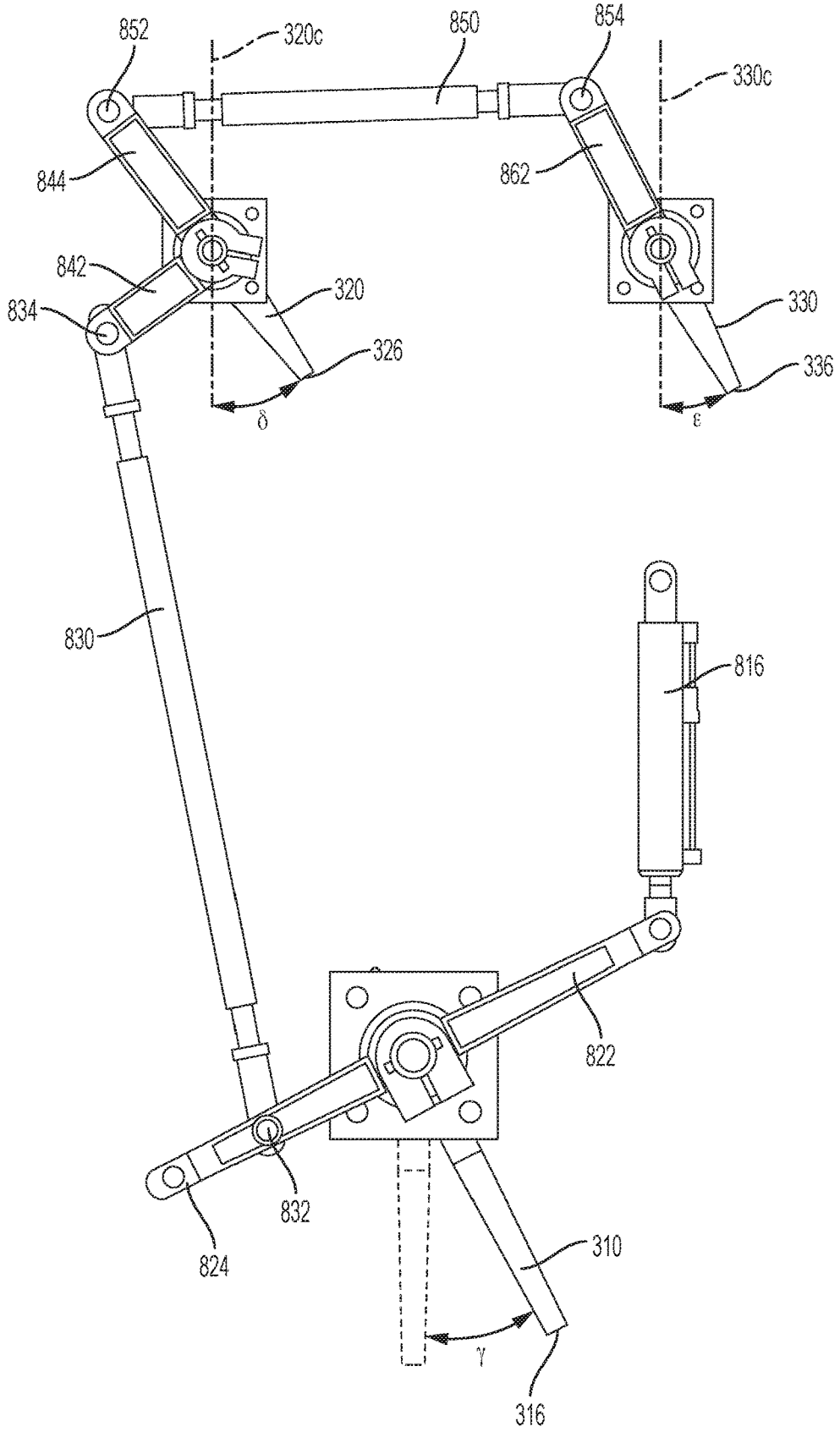
FIG. 10 is the top view of the rudder assembly shown in FIG. 8A in a position for a turn to starboard when the boat is moving forward.

In the preferred embodiment, all three rudders 310, 320, 330 are rotated in concert and about their respective rotation axes 310*a*, 320*a*, 330*a* to maneuver the boat 100. The rudder assembly 300 may be operated as follows to turn the boat 100 as it moves forward. To turn to port, the forward edge 314, 324, 334 of each rudder 310, 320, 330 is rotated to starboard from the neutral position, and correspondingly, the aft edge 316, 326, 336 of each rudder 310, 320, 330 is rotated to port from the neutral position. When the flanking rudders 320, 330 are toed-in, the starboard flanking rudder 330 is preferably rotated through line 330*c* to generate a force that assists in turning the boat 100 and not one that resists, and when the flanking rudders 320, 330 are toed-out, the port flanking rudder 320 is preferably rotated through line 320*c*. Conversely, to turn to starboard, the forward edge 314, 324, 334 of each rudder 310, 320, 330 is rotated to port from the neutral position, and correspondingly, the aft edge 316, 326, 336 of each rudder 310, 320, 330 is rotated to starboard from the neutral position. When the flanking rudders 320, 330 are toed-in, the port flanking rudder 320 is preferably rotated through line 320*c* to likewise generate a force to assist in turning the boat 100 and not one that resists, and when the flanking rudders 320, 330 are toed-out the starboard flanking rudder 330 is preferably rotated through line 330*c*. FIG. 9 is a top view of the rudder assembly 300 turned hard over to port, and FIG. 10 is a top view of the rudder assembly 300 turned hard over to starboard. The inventors have found that a boat having the two flanking rudders 320, 330 in addition to the main rudder 310 has a smaller minimum turning radius than a boat having only a main rudder.

When the boat 100 is moving in reverse, the rudders 310, 320, 330 are rotated in a manner similar to the way the rudders 310, 320, 330 are rotated when the boat 100 is moving forward. To turn to port, the aft edge 316, 326, 336 of each rudder 310, 320, 330 is rotated to port from the neutral position, and correspondingly, the forward edge 314, 324, 334 of each rudder 310, 320, 330 is rotated to starboard from the neutral position. Conversely, to turn to starboard, the aft edge 316, 326, 336 of each rudder 310, 320, 330 is rotated to starboard from the neutral position, and correspondingly, the forward edge 314, 324, 334 of each rudder 310, 320, 330 is rotated to port from the neutral position. As in the forward direction when the flanking rudders 320, 330 are toed-in, the starboard flanking rudder 330 is preferably rotated through line 330*c* when turning to port and the port flanking rudder 320 is preferably rotated through line 320*c* when turning to starboard. Likewise, when the flanking rudders 320, 330 are toed-out, the port flanking rudder 320 is preferably rotated through line 330*c* when turning to port and the starboard flanking rudder 330 is preferably rotated through line 323*c* when turning to starboard.

Rudders work best when there is high-velocity flow over the surfaces of the rudder. As a result, a boat having only a main rudder 310 positioned aft of the propeller 342 may not generate enough lift in reverse to overcome lateral forces generated by the propeller 342 rotation because the main rudder 310 is outside of the reverse race 420 and the boat is typically operating at low speed. Thus, the rear of the boat may pull to starboard, even if the main rudder 310, in a main rudder-only configuration, is rotated hard over to turn the boat to port. The inventors have found that using the flanking rudders 320, 330 may counteract this adverse effect, especially if the flanking rudders 320, 330 are positioned as discussed above.

Each of the rudders 310, 320, 330 may have a rotation angle γ, δ, ε. In this embodiment, the rotation angle γ of the main rudder 310 may be measured from the neutral position of the main rudder 310. Thus the rotation angle γ of the main rudder 310 is relative to the centerline 202 of the boat 100 when the main rudder post 312 is aligned with the centerline 202 of the boat 100 as shown in FIG. 5. Also in this embodiment, the rotation angle δ of the port flanking rudder 320 may be measured from line 320*c*, and the rotation angle ε of the starboard flanking rudder 330 may be measured from line 330*c*.

During a turn, the rotation angles γ, δ, ε may be the same, but in some instances, it may be advantageous for each rudder 310, 320, 330 to be rotated to different angles. The inventors have also found that it may be beneficial for the rotation angles δ, ε of the flanking rudders 320, 330 to be greater than the rotation angle γ of the main rudder 310 during a turn. Although it may also be beneficial in other situations for the rotation angle γ of the main rudder 310 to be greater than the rotation angles δ, ε of the flanking rudders 320, 330. In addition, it may also be beneficial for the rotation angles δ, ε of the flanking rudders 320, 330 to be different. In particular, it may be beneficial for the rotation angle δ, ε of the flanking rudder 320, 330 on the outside of the turn (for example, rotation angle ε of the starboard flanking rudder 330 during a turn to port) to be less than the rotation angle δ, ε of the flanking rudder 320, 330 on the inside of the turn (for example, rotation angle δ of the port flanking rudder 320 during a turn to port). Although, again, in other instances it may be beneficial for the rotation angle δ, ε of the flanking rudder 320, 330 on the inside of the turn to be less than or equal to the rotation angle δ, ε of the flanking rudder 320, 330 on the inside of the turn.

Figure 8A:
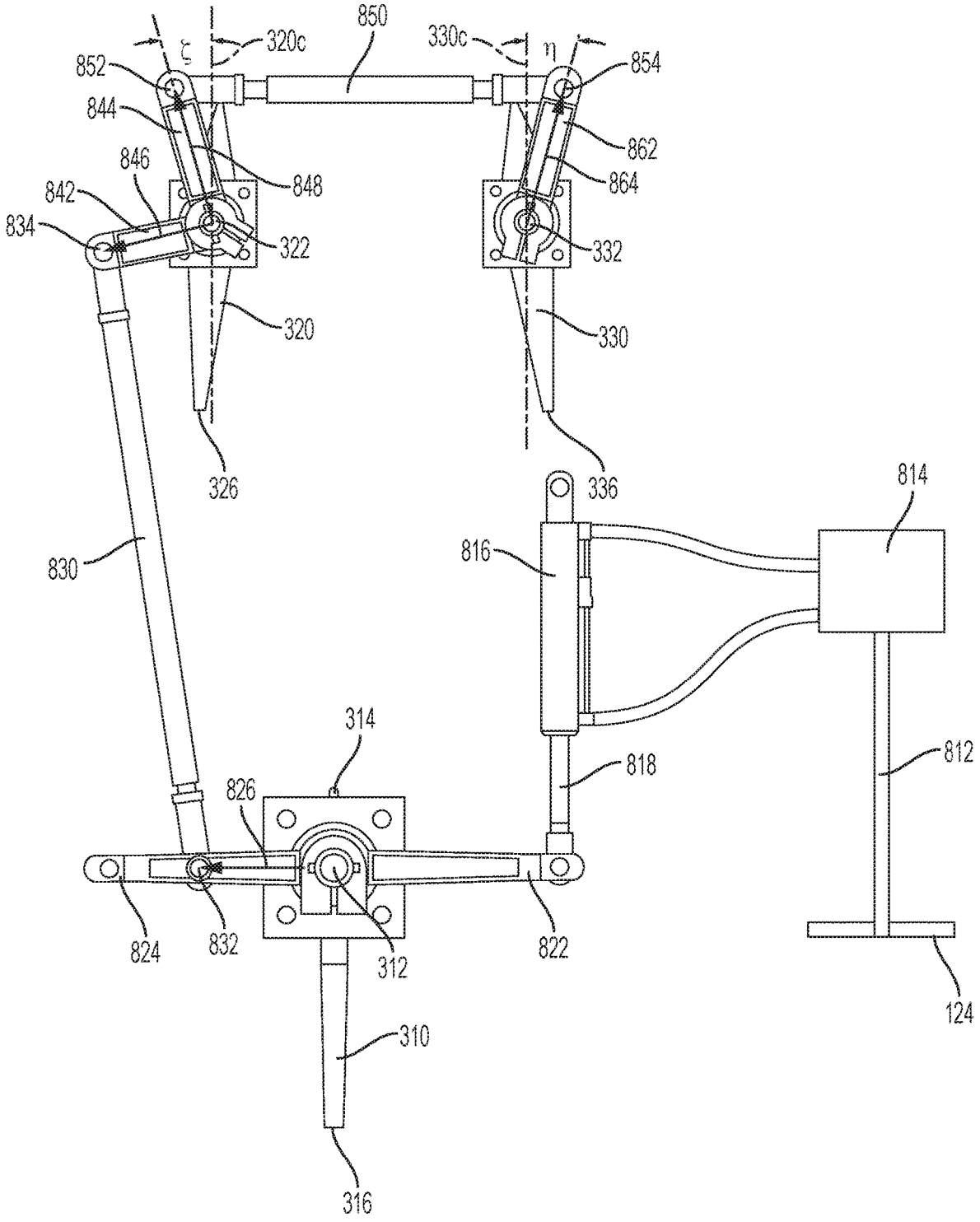
FIG. 8A is a top view of a rudder assembly according to a preferred embodiment of the invention.

In this embodiment, the flanking rudders 320, 330 are linked to the main rudder 310 such that they all rotate together. FIG. 8A is a top view of the rudder assembly 300 showing the main rudder 310, flanking rudders 320, 330, and the linkages between them (the engine 610 and associated drive components (e.g., propeller 342 and drive shaft 344) and hull bottom 210 are omitted for clarity). Hydraulic steering is used in this embodiment, although any suitable steering mechanism may be used, including rack-and-pinion cable steering or electric steering for example. The rudders 310, 320, 330 may be turned using a steering wheel 124 located at the control console 120 (see FIG. 1). A user may turn the boat 100 by rotating the steering wheel 124, which in turn, rotates a steering column 812. A hydraulic pump 814 is located is located on the steering column 812 and pumps hydraulic fluid into or out of a hydraulic cylinder 816 to extend or retract the ram 818 of the hydraulic cylinder 816.

The hydraulic cylinder 816 is connected to a first tiller arm 822 of the main rudder 310. In the configuration shown in FIG. 8A, the first tiller arm 822 is connected to the main rudder post 312 at a 90° angle to the chord 310*b* of the main rudder 310. With the main rudder 310 in its neutral position, extending the ram 818 pushes the first tiller arm 822 aft, rotates the post 312, and turns the aft edge 316 of the main rudder 310 to port, as shown in FIG. 9. Conversely, retracting the ram 818 with the main rudder 310 in its the neutral position pulls the first tiller arm 822 forward, rotates the post 312, and turns the aft edge 316 of the main rudder 310 to starboard, as shown in FIG. 10.

A first linkage 830 is used to couple the flanking rudders 320, 330 to the main rudder 310. In the configuration shown in FIG. 8A, a single first linkage 830 is used to connect the port flanking rudder 320 to the main rudder 310. Skilled artisans will recognize, based on the following disclosure, how the first linkage 830 could be used to connect the main rudder 310 with the starboard flanking rudder 330, instead of the port flanking rudder 320. The first linkage 830 is located on the opposite side of the main rudder 310 from the hydraulic cylinder 816 and connected to a second tiller arm 824 of the main rudder 310 at a connection point 832. The second tiller arm 824 is connected to the post 312 at a 90° angle to the chord 310*b*. Although referenced as separate tiller arms, skilled artisans will recognize that the first and second tiller arms 822, 824 of the main rudder 310 may also be a single tiller arm. For example, the tiller arm for the main rudder 310 may be a single cast piece having a keyway used to connect to the main rudder shaft 312 and first and second portions, corresponding to the first and second tiller arms 822, 824, respectively. In this embodiment, the first linkage 830 is a rod with adjustable length that can transmit force to turn the port flanking rudder 320 either by pushing or pulling, although any suitable linkage may be used.

The port flanking rudder 320 has a first tiller arm 842 that is connected to the post 322 and extends outboard from the post 322. The first linkage 830 is connected the first tiller arm 842 of the port flanking rudder 320 at a connection point 834. Each connection point 832, 834 of the first linkage 830 is located on the same side relative to the rudder post 312, 322 to which it corresponds. In this embodiment, both connection points 832, 834 are located on the port side of their corresponding rudder posts 312, 322. When the main rudder 310 is turned to port, the second tiller arm 824 of the main rudder 310 moves forward, pushing the first linkage 830 forward. When the first linkage 830 moves forward, it pushes the first tiller arm 842 of the port flanking rudder 320 forward and rotates the aft edge 326 of the port flanking rudder 320 to port. Conversely, when the first linkage 830 moves aft, it pulls the first tiller arm 842 of the port flanking rudder 320 aft and rotates the aft edge 326 of the port flanking rudder 320 to starboard.

A second linkage 850 is used to couple the flanking rudders 320, 330 to each other. In the configuration shown in FIG. 8A, a single second linkage 850 is used to connect the starboard flanking rudder 330 to the port flanking rudder 320. The port flanking rudder 320 has a second tiller arm 844 that is connected to the post 322 and extends forward from the post 322. The second linkage 850 is connected the second tiller arm 844 of the port flanking rudder 320 at a connection point 852. Although referenced as separate tiller arms, skilled artisans will recognize that the first and second tiller arms 842, 844 of the port flanking rudder 320 may also be a single tiller arm. For example, the tiller arm for the port flanking rudder 320 may be a single cast piece having a keyway used to connect to the main rudder shaft 312 and first and second portions, corresponding to the first and second tiller arms 842, 844, respectively.

The starboard flanking rudder 330 has a tiller arm 862 that is connected to the post 332 and also extends forward from the post 332. The second linkage 850 is connected the tiller arm 862 of the starboard flanking rudder 330 at a connection point 854. Each connection point 852, 854 of the second linkage 850 is located on the same side relative to the rudder post 322, 332 to which it corresponds. In this embodiment, both connection points 852, 854 are located forward of their corresponding rudder post 322, 332. As with the first linkage 830, the second linkage 850 of this embodiment is a rod with adjustable length that can transmit force to turn the starboard flanking rudder 330 either by pushing or pulling, although any suitable linkage may be used.

As the aft edge 326 of the port flanking rudder 320 rotates to port (i.e., when the first linkage 830 moves forward), the second tiller arm 844 rotates to starboard pushing the second linkage 850 to starboard. As the second linkage 850 moves to starboard, it pushes the tiller arm 862 of the starboard flanking rudder 330 to starboard and rotates the aft edge 336 of the starboard flanking rudder 330 to port. Conversely, as the aft edge 326 of the port flanking rudder 320 rotates to starboard (i.e., when the first linkage 830 moves aft), the second tiller arm 844 rotates to port pulling the second linkage 850 to port. As the second linkage 850 moves to port, it pulls the tiller arm 862 of the starboard flanking rudder 330 to port and rotates the aft edge 336 of the starboard flanking rudder 330 to starboard.

As discussed above, the flanking rudders 320, 330 may be rotated to a different rotation angle δ, ε than the main rudder 310 during a turn. The different rotation angles may be achieved by having a different relative rate of rotation between a drive rudder and a rudder being driven. For example, in the configuration shown in FIG. 8A, the main rudder 310 is the drive rudder, and the port flanking rudder 320 is the rudder being driven (driven rudder) by the main rudder 310. Each connection point 832, 834, 852, 854 is located on a tiller arm 824, 842, 844, 862, which in turn is associated with the rotation axis 310*a*, 320*a*, 330*a* for each rudder 310, 320, 330. If the distance between the connection point and corresponding rotation axis for the driven rudder is less than the distance between the connection point and corresponding rotation axis for the drive rudder, the driven rudder will rotate faster than the drive rudder. In the configuration shown in FIG. 8A, for example, the connection point 834 of the first linkage 830 on the first tiller arm 842 of the port flanking rudder 320 is closer to its corresponding rotation axis 320*a* than the connection point 832 of the first linkage 830 on the second tiller arm 824 of the main rudder 310 is to its corresponding rotation axis 310*a*. Thus, in this configuration, the rate of rotation for the port flanking rudder 320 is faster than the rate of rotation for the main rudder 310. Conversely, the driven rudder will rotate slower than the drive rudder if the distance between the connection point and corresponding rotation axis for the driven rudder is greater than the distance between the connection point and corresponding rotation axis for the drive rudder.

Angling the two tiller arms, which are connected by a linkage 830, 850, relative to each other also adjusts the relative rotation rates between the two rudders. Each connection point 832, 834, 852, 854 may be associated with a vector that originates at the corresponding rotation axis 310*a*, 320*a*, 330*a* and is perpendicular to that rotation axis 310*a*, 320*a*, 330*a* when the rudder 310, 320, 330 is in its neutral position. In the embodiment shown in FIG. 8A, a first vector 826 originates at the rotation axis 310*a* for the main rudder 310 and extends to the connection point 832 on the second tiller arm 824 of the main rudder 310. A second vector 846 originates at the rotation axis 320*a* for the port flanking rudder 320 and extends to the connection point 834 on the first tiller arm 842 of the port flanking rudder 320. A third vector 848 also originates at the rotation axis 320*a* for the port flanking rudder 320 but extends to the connection point 852 on the second tiller arm 844 of the port flanking rudder 320. Likewise, a fourth vector 864 originates at the rotation axis 330*a* for the starboard flanking rudder 330 and extends to the connection point 854 on the tiller arm 862 of the starboard flanking rudder 330.

In an embodiment where the tiller arms 824, 842, 844, 862 are straight, such as FIG. 8A, the tiller arms 824, 842, 844, 862 can be said to have the direction of the respective vectors 826, 846, 848, 864. For example, two linked tiller arms may be considered to point toward each other if the vectors corresponding to these tiller arms intersect when viewed from above. In FIG. 8A, the second tiller arm 824 of the main rudder 310 and the first tiller arm 842 of the port flanking rudder 320 are pointed toward each other. Conversely, two linked tiller arms may be considered to point away from each other if the vectors corresponding to these tiller arms diverge when viewed from above. In FIG. 8A, the second tiller arm 844 of port flanking rudder 320 and the tiller arm 862 of the starboard flanking rudder 330 are pointed away from each other.

When two linked tiller arms, such as the second tiller arm 824 of the main rudder 310 and the first tiller arm 842 of the port flanking rudder 320 shown in FIG. 8A, are angled toward each other, the driven rudder (port flanking rudder 320 in FIG. 8A) rotates slower than the drive rudder (main rudder 310 in FIG. 8A) if the drive rudder is rotated in a clockwise direction as viewed from above, but the driven rudder (port flanking rudder 320 in FIG. 8A) rotates faster than the drive rudder (main rudder 310 in FIG. 8A) if the drive rudder is rotated in a counterclockwise direction as viewed from above. In the configuration shown in FIG. 8A, however, the overall relative rate of rotation of the port flanking rudder 320 is increased relative to the main rudder 310 even when rotating in a counterclockwise direction because, as discussed above, the connection point 834 for the port flanking rudder 320 is closer to its corresponding rotation axis 320*a* than the connection point 832 for the main rudder 310 is to its corresponding rotation axis 310*a*, which overcomes the slowing effect of the tiller arms 824,842 being pointed toward each other. The flanking rudders 320, 330 are thus configured to rotate faster than the main rudder 310.

As also discussed above, it is beneficial for the flanking rudder 320, 330 on the outside of the turn (for example, the starboard flanking rudder 330 during a turn to port) to pass through line 320*c* or line 330*c*. In the configuration shown in FIG. 8A, this is accomplished by angling the second tiller arm 844 of the port flanking rudder 320 and the tiller arm 862 of the starboard flanking rudder 330 shown in FIG. 8A away from each other. When two linked tiller arms are angled away from each other, the driven rudder (starboard flanking rudder 330 in FIG. 8A) rotates faster than the drive rudder (port flanking rudder 320 in FIG. 8A) if the drive rudder is rotated in a clockwise direction as viewed from above, but the driven rudder (starboard flanking rudder 330 in FIG. 8A) rotates slower than the drive rudder (port flanking rudder 320 in FIG. 8A) if the drive rudder is rotated in a counterclockwise direction as viewed from above.

In the embodiment shown in FIG. 8A, the second tiller arm 844 of the port flanking rudder 320 is offset from line 320*c* by an offset angle ζ. Likewise, the tiller arm 862 of the starboard flanking rudder 330 is offset from line 330*c* by an offset angle η. Preferably, the third vector 848 and fourth vector 864 are symmetrical about the centerline 202 of the boat 100 and the offset angles ζ, η are equal. Also, the offset angles are preferably the same as the angles of toe α, β.

Figure 8B:
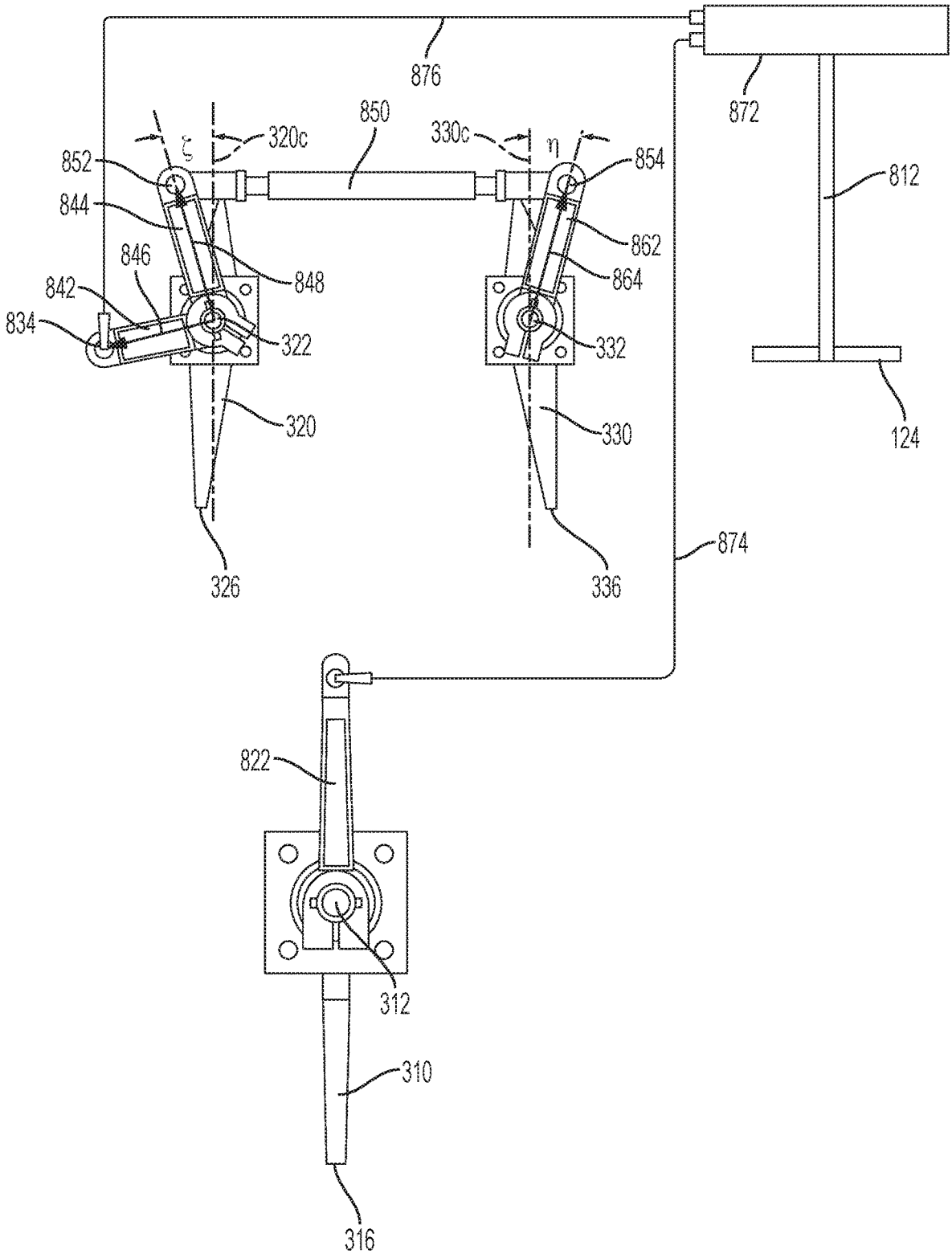
FIG. 8B is a top view of the rudder assembly shown in FIG. 8A with an alternate steering system.

FIG. 8B shows an embodiment having an alternate steering control arrangement using rack and pinion cable steering. A user may turn the boat 100 by rotating the steering wheel 124, which in turn, rotates a steering column 812. A rack and pinion assembly 872 is located on the end of the steering column 812. Rotating the steering column 812 turns a pinion gear, which in turn translates a rack. Connected to the end of the rack are two steering cables, a main steering cable 874, and a flanking rudder steering cable 876. As the rack translates to starboard, it pulls the steering cables 874, 876, and moves the first tiller arm 822 of the main rudder 310 (only tiller arm in the configuration shown in FIG. 8B) and the first tiller arm 842 of the port flanking rudder 320 to turn the rudders 310, 320, 330, just as extending the ram 818 does in the configuration shown in FIG. 8A. Likewise, as the rack translates to port, it pushes the steering cables 874, 876, and moves the first tiller arm 822 of the main rudder 310 and the first tiller arm 842 of the port flanking rudder 320 to turn the rudders 310, 320, 330, just as retracting the ram 818 does in the configuration shown in FIG. 8A.

In the configuration shown in FIG. 8B, the flanking rudders 320, 330 are turned in concert with the main rudder 310 through the use of a common rack, and thus the first linkage 830 is not necessary. As with the first linkage 830 discussed above, the relative rates of rotation between the main rudder 310 and the flanking rudders 320, 330 may be adjusted by the relative distances between the connection point of the steering cable 874, 876 to the tiller arm 822, 842 and corresponding rotation axis 310*a*, 320*a*. As shown in FIG. 8B for example, the flanking rudders 320, 330 rotate faster than the main rudder 310 because the distance between the rotation axis 320*a* of the port flanking rudder 320 and the point where the flanking rudder steering cable 376 attaches to the tiller arm 842 is shorter than the distance between the rotation axis 310*a* of the main rudder 310 and the point where the main rudder steering cable 374 attaches to the tiller arm 822.

In the configuration shown in FIG. 8A, the first and second linkages 830, 840 are manually adjustable rods, and the toed-in or toed-out orientation of the flanking rudders 320, 330 is set during boat construction or a maintenance operation. In other words, the toed-in or toed-out orientation is not readily adjustable, and the orientation of the flanking rudders 320, 330 is generally set to maximize the neutral feel of the flanking rudders 320, 330 over the widest range of operating conditions. There may, however, be some operating conditions where another orientation of the flanking rudders 320, 330 would be beneficial. For example, using toe-out when the boat 100 is in reverse, but toe-in when the boat 100 is moving forward. Instead of using manually adjustable linkages 830, 840, an actuator may be used to change the orientation of the flanking rudders 320, 330 on the fly. Any suitable actuator may be used including, for example, motors or linear actuators, which may be used as remotely adjustable linkages 1110, 1120 as discussed in the preferred embodiment below.

Figure 11:
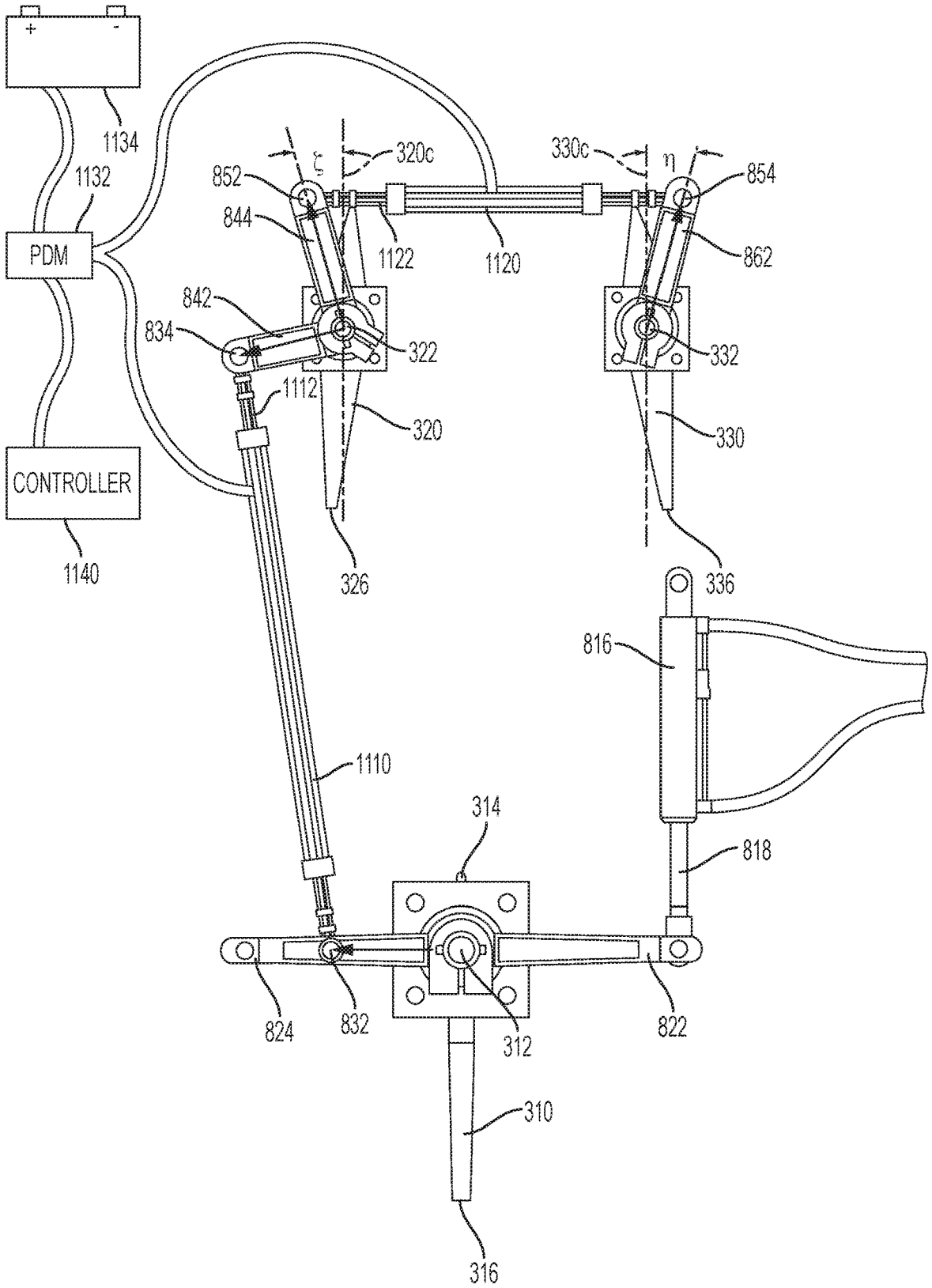
FIG. 11 is a top view of a rudder assembly according to another preferred embodiment of the invention.

As shown in FIG. 11, first and second remotely adjustable linkages 1110, 1120 are used instead of the first and second linkages 830, 850 discussed above. The remotely adjustable linkages 1110, 1120 may be electrical linear actuators, although any suitable remotely adjustable linkage may be used including, for example, hydraulic and pneumatic actuators. The first and second remotely adjustable linkages 1110, 1120 are each connected to a power distribution module ("PDM") 1132, which in turn, is connected to a power source 1134 and a controller 1140. Any suitable power distribution module may be used, and any suitable power source may be used, including, for example, the boat's onboard battery.

The controller 1140 provides an input control signal to the power distribution module 1132, which then provides power to the first and second remotely adjustable linkages 1110, 1120 to drive them in the appropriate direction. In FIG. 11, the flanking rudders 320, 330 are shown toed-in. When the input control signal is received by the power distribution module 1132 from the controller 1140 to change the orientation from toed-in to toed-out, the power distribution module 1132 provides power from the power source 1134 to the first remotely adjustable linkage 1110 to retract the ram 1112 and provides power from the power source 1134 to the second remotely adjustable linkage 1120 to extend the ram 1122. Conversely, to move the flanking rudders 320, 330 from a toed-out orientation to a toed-in orientation the power distribution module 1132 provides power to the first remotely adjustable linkage 1110 to extend the ram 1112 and provides power to the second remotely adjustable linkage 1120 to retract the ram 1122. In addition to moving between toed-in and toed-out configurations, the flanking rudders 320, 330 may be moved to and from an orientation where the chord 320*b*, 330*b* of each flanking rudder is parallel to the centerline 202 of the boat 100.

The controller 1140 may be any suitable controller including a microprocessor based controller that has a processor and a memory. The controller 1140 may be responsive to an input device 126. The input device 126 may be preferably located at the control console 120 (see FIG. 1) in order to receive inputs from the operator; such an input device 126 may include a switch or a touch screen, for example. The operator may adjust the angle of toe α, β by selecting the appropriate direction on the input device 126 and the controller generates a control signal to the power distribution module 1132 for the length of time the direction on the input device 126 is selected. There may be a stop to limit the range of travel of the first and second remotely adjustable linkages 1110, 1120. The stop may be, for example, a mechanical stop associated with the rams 1112, 1122 of the first and second remotely adjustable linkages 1110, 1120, an electrical stop associated with the motor of the adjustable linkage 1110, 1120, or even a limit programmed into the control software stored in the memory of the controller 1140.

The controller 1140 may also have a plurality of programmed angles of toe α, β stored its memory. For example, no toe (an angle α, β of zero), toed-in 5°, toed-in 10°, toed-out 5°, toed-out 10°. A user may then select one of these programmed positions through the input device 126, and in response to the user's selection, the controller 1140 sends the appropriate control signal to power distribution module 1132 to drive the first and second remotely adjustable linkages 1110, 1120 to the programmed positions.

The controller 1140 does not need to be responsive to an input device 126 operated by the user. Instead, the controller 1140 may be responsive to various other switches and sensors that monitor or are activated by various operating conditions of the boat. For example, one angle of toe α, β may be preferred when the boat is operating in the forward direction (e.g., toed-in at 5°), and another angle of toe α, β may be preferred when the boat is operating in the reverse direction (e.g., toed-out at 5°). Thus, the controller 1140 may be responsive to the control lever 122, such that controller 1140 sets the angle of toe α, β from one of the plurality of programmed angles of toe α, β based on the direction the boat 100 is being driven. Other operational conditions that the controller 1140 may be programmed to adjust the angle of toe α, β include, for example, a speed range, an engine RPM range, gear positions, or steering compensation.

The rams 1112, 1122 of the first and second remotely adjustable linkages 1110, 1120 are preferably moved both concurrently and the same distance. As discussed above, the port and starboard flanking rudders 320, 330 are preferably symmetrical about the centerline 202, and moving the rams 1112, 1122 concurrently the same distance may be desirable to maintain this symmetry. However, those skilled in the art will recognize that the controller 1140 and associated input device 126, such as touch screen 126, may be configured to operate each of the first and second remotely adjustable linkages 1110, 1120 independently and to extend and retract the rams 1112, 1122 different distances.

Figure 12:
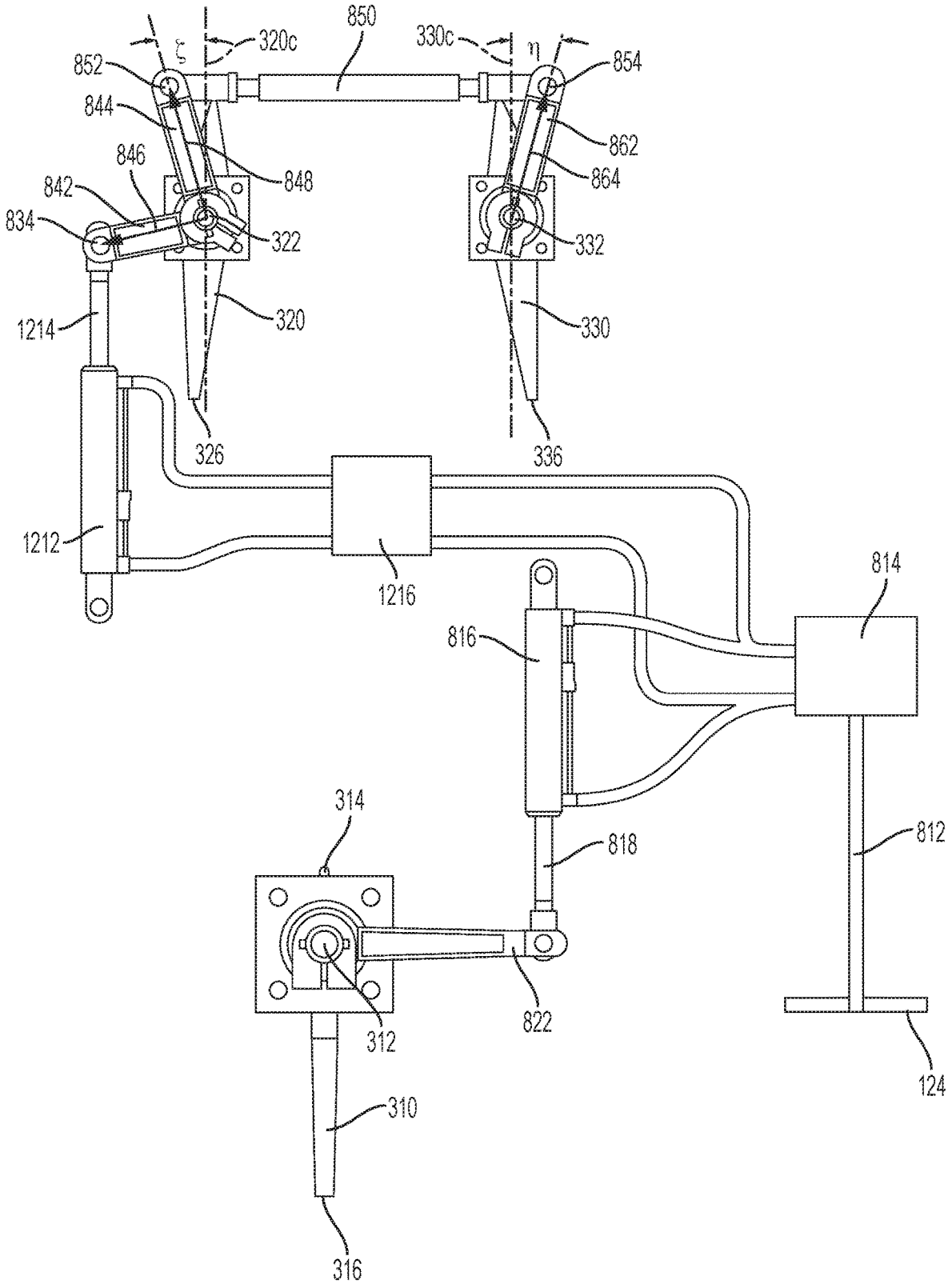
FIG. 12 is a top view of a rudder assembly according to another preferred embodiment of the invention.

In the embodiments discussed above, the flanking rudders 320, 330 are turned in concert with the main rudder 310. Under some operational conditions, it may be preferable to decouple the flanking rudders 320, 330 from the main rudder 310. For example, it may be beneficial for the flanking rudders 320, 330 to turn in concert with the main rudder 310 during reverse operation, but remain fixed during high speed forward operation. A suitable configuration for decoupling the flanking rudders 320, 330 from the main rudder 310 is shown in FIG. 12. In this configuration, the main rudder 310 and port flanking rudder 320 are not linked by the first linkage 830. Instead, the flanking rudders are turned by a second hydraulic cylinder 1212 and ram 1214. The second hydraulic cylinder 1212 may also be operated by the hydraulic pump 814. A valve 1216 may be placed between the pump 814 and the second hydraulic cylinder 1212. The valve 1216 may be closed to decouple the flanking rudders 320, 330 from the main rudder. In addition to being operated by the user, the valve 1216 may be operated the controller 1140 and responsive to the operational conditions of the boat 100 as discussed above.

The embodiments discussed above include a pair of flanking rudders 320, 330. Having a pair of flanking rudders 320, 330 is desirable for a number of reasons, including for example, maintaining a balanced load on either side of the boat's centerline 202 when the flanking rudders are angled relative to the forward and aft direction of the boat 100. However, a single flanking rudder 320, 330 positioned forward of the propeller 342, may also be suitable.

Figure 13:
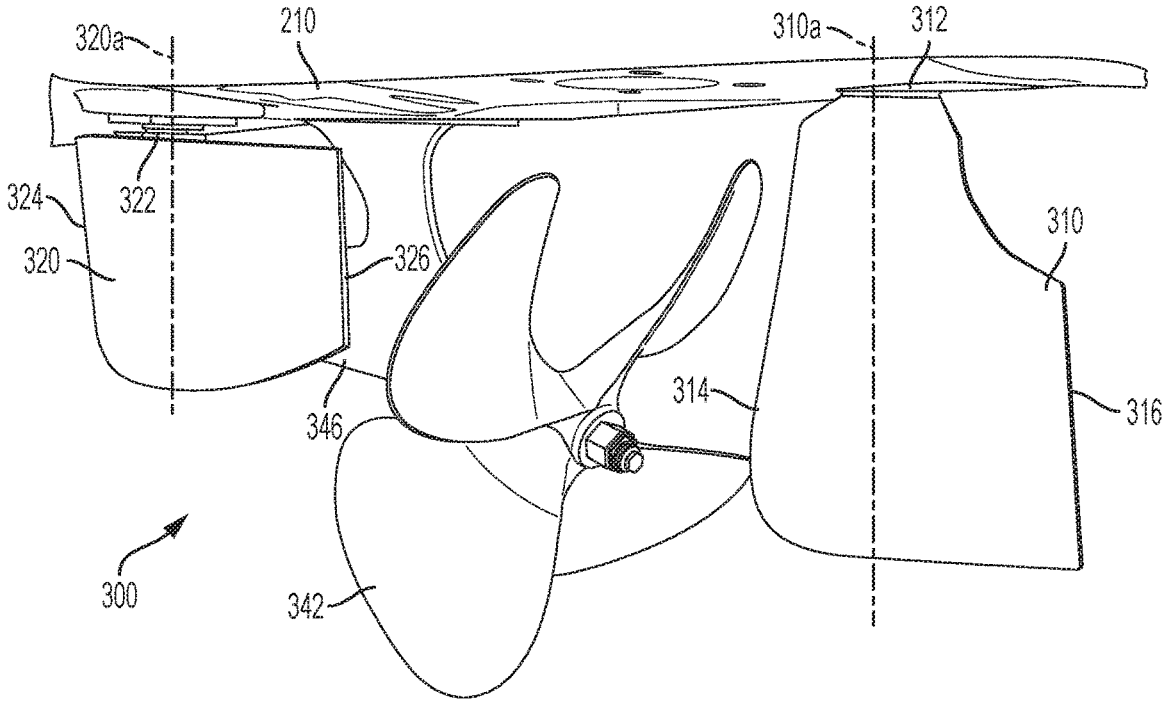
FIG. 13 is a detailed perspective view of a rudder assembly according to another preferred embodiment of the invention.
Figure 14:
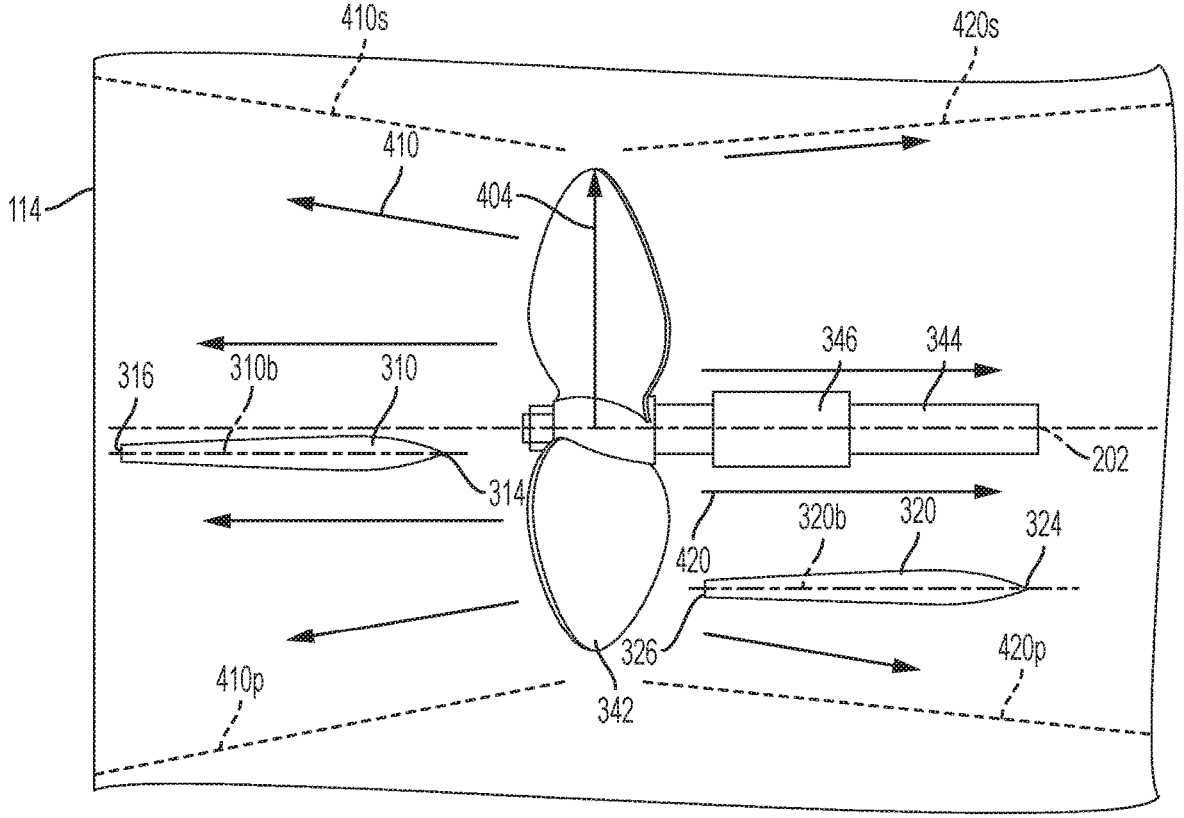
FIG. 14 is a bottom view of the rudder assembly and section of the hull shown in FIG. 13.
Figure 15:
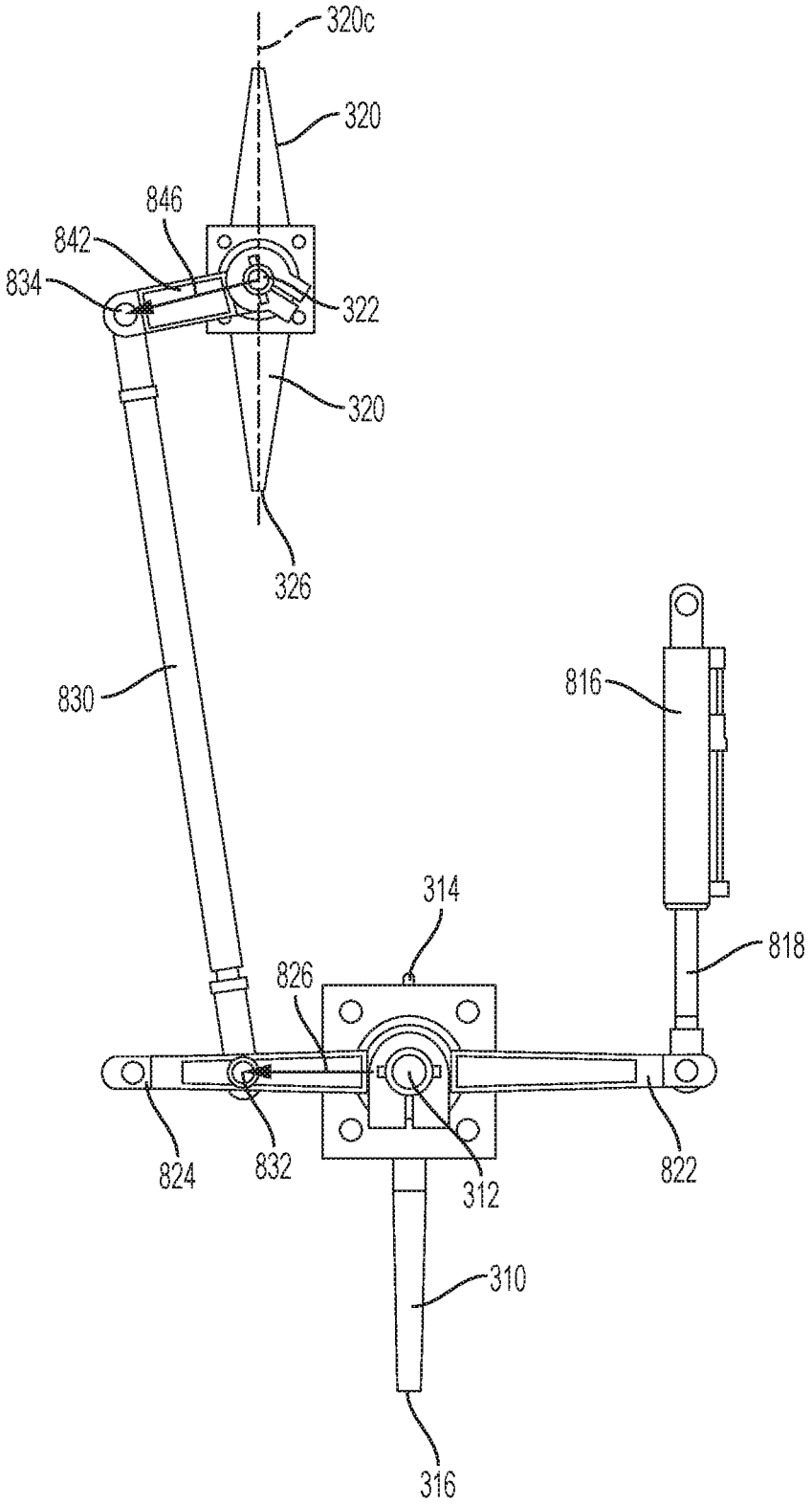
FIG. 15 is a top view of the rudder assembly shown in FIG. 13.
Figure 16:
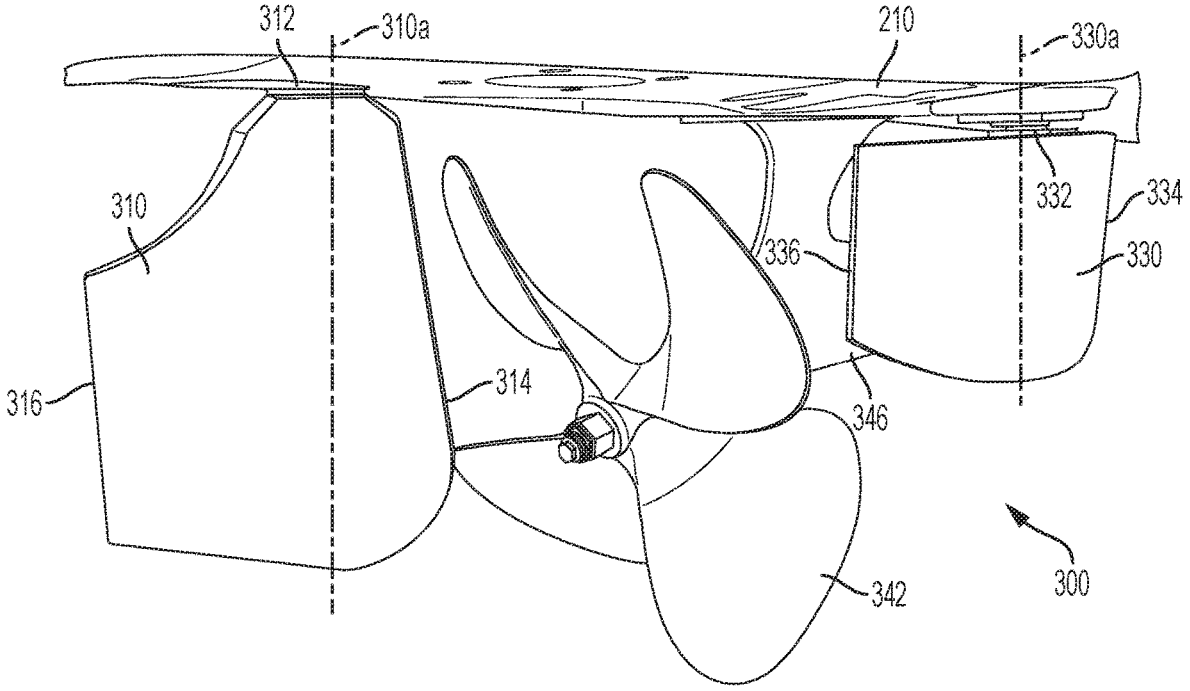
FIG. 16 is a detailed perspective view of a rudder assembly according to a further preferred embodiment of the invention.
Figure 17:
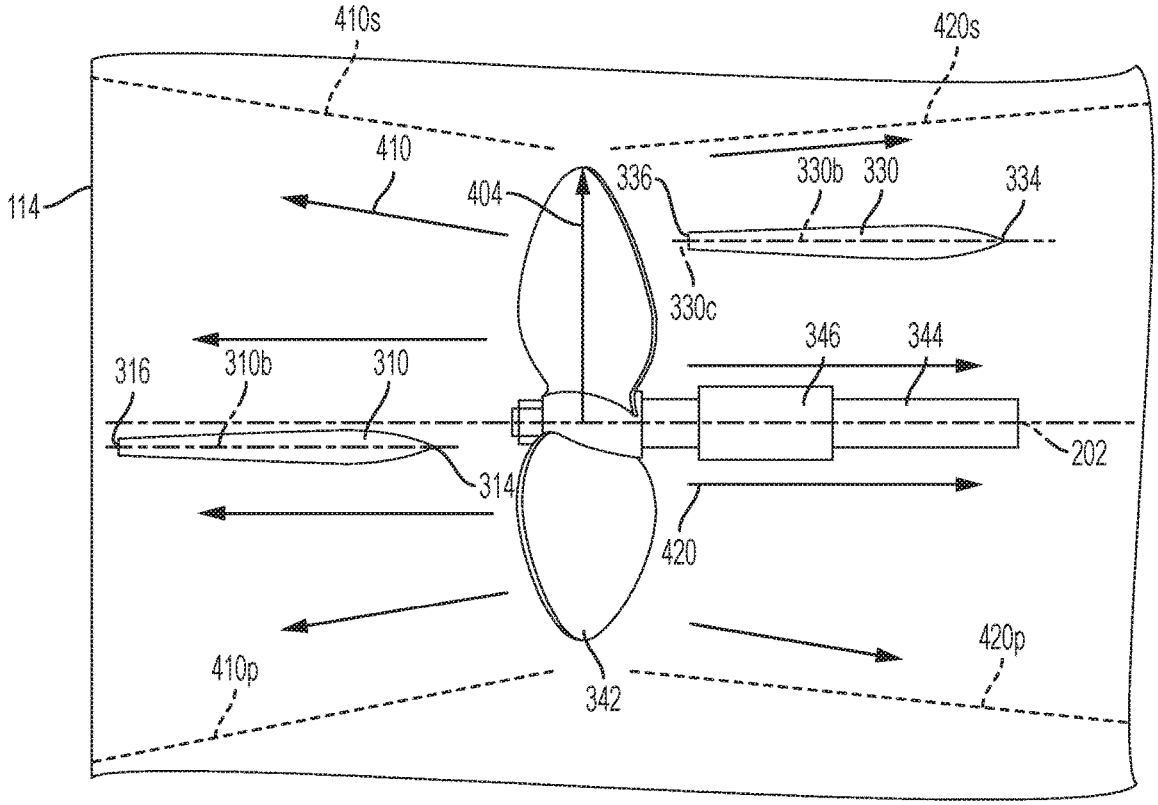
FIG. 17 is a bottom view of the rudder assembly and section of the hull shown in FIG. 16.
Figure 18:
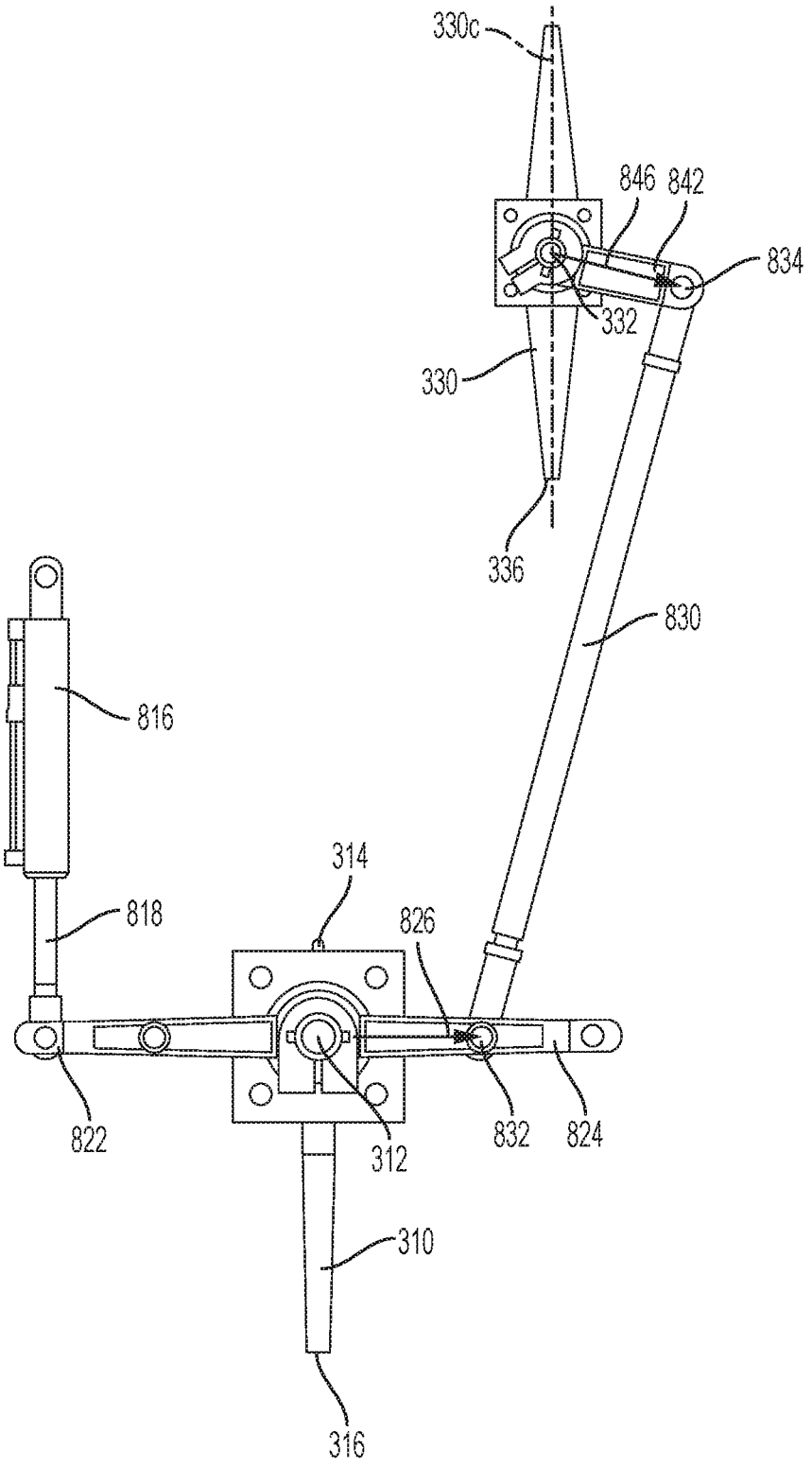
FIG. 18 is a top view of the rudder assembly shown in FIG. 16.

The single flanking rudder 320, 330 is positioned to intersect the reverse race 420 when rotated from its neutral position and sized to generate sufficient lift to counteract any yaw moment generated by the propeller 342 in when the boat 100 is operated in reverse. As a result, the single flanking rudder 320, 330 is preferably offset from the centerline 202 of the boat 100. An embodiment having a single flanking rudder 320 positioned on the port side of the boat is shown in FIGS. 13, 14, and 15, and an embodiment having a single flanking rudder 330 positioned on the starboard side of the boat is shown in FIGS. 16, 17, and 18. The embodiment with a single flanking rudder 320, 330 operates similarly to the embodiment discussed above having a pair of flanking rudders 320, 330, and the same reference numerals are used to denote the same or similar features in FIGS. 13-18 as in FIGS. 1-12. Although, the single flanking rudder 320, 330 may be either toed-in or toed-out, under most circumstances, the chord 320*b*, 330*b* of the single flanking rudder 320, 330 is preferably parallel to the centerline 202 when the rudder 320, 330 is in its neutral position.

The embodiments discussed herein are examples of preferred embodiments of the present invention and are provided for illustrative purposes only. They are not intended to limit the scope of the invention. Although specific configurations, structures, etc. have been shown and described, such are not limiting. Modifications and variations are contemplated within the scope of the invention, which is to be limited only by the scope of the issued claims.

What is claimed is:

1. A method of turning a boat having a planing hull, the method comprising:

spinning a propeller in a direction to move the boat in reverse and to accelerate a stream of water;

rotating a port flanking rudder from a first position to a second position about a rotation axis positioned forward of the propeller, the port flanking rudder intersecting the stream of water accelerated by the propeller in the second position, the port flanking rudder being positioned beneath a bottom of a planing hull of the boat and on port side of a centerline of the planing hull;

rotating a starboard flanking rudder from a first position to a second position about a rotation axis positioned forward of the propeller, the starboard flanking rudder intersecting the stream of water accelerated by the propeller in the second position, the starboard flanking rudder being positioned beneath a bottom of a planing hull of the boat and on starboard side of a centerline of the planing hull.

2. The method of claim 1, wherein the first position of each of the port and starboard flanking rudders is a neutral position.

3. The method of claim 1, wherein the port flanking rudder is rotated from the first position to the second position by rotating the aft edge of the port flanking rudder in a port direction about the rotation axis of the port flanking rudder, and wherein the starboard flanking rudder is rotated from the first position to the second position by rotating the aft edge of the starboard flanking rudder in port direction about the rotation axis of the starboard flanking rudder.

4. The method of claim 3, wherein the first position of each of the port and starboard flanking rudders is a neutral position and the boat is turned to port by rotating the aft edge of each of the port and starboard flanking rudders to port.

5. The method of claim 1, wherein the port flanking rudder is rotated from the first position to the second position by rotating the aft edge of the port flanking rudder in a starboard direction about the rotation axis of the port flanking rudder, and wherein the starboard flanking rudder is rotated from the first position to the second position by rotating the aft edge of the starboard flanking rudder in starboard direction about the rotation axis of the starboard flanking rudder.

6. The method of claim 5, wherein the first position of each of the port and starboard flanking rudders is a neutral position and the boat is turned to starboard by rotating the aft edge of each of the port and starboard flanking rudders to starboard.

7. The method of claim 1, wherein:

positioning the port flanking rudder in the second position forms a rotation angle between the chord of the port flanking rudder and a line that is (i) parallel to the centerline of the boat and (ii) intersects the rotation axis of the port flanking rudder, positioning the starboard flanking rudder in the second position forms a rotation angle between the chord of the starboard flanking rudder and a line that is (i) parallel to the centerline of the boat and (ii) intersects the rotation axis of the starboard flanking rudder.

8. The method of claim 7, wherein, in the second position, the rotation angle of the port flanking rudder is larger than the rotation angle of the starboard flanking rudder.

9. The method of claim 7, wherein, in the second position, the rotation angle of the starboard flanking rudder is larger than the rotation angle of the port flanking rudder.

10. The method of claim 7, wherein, in the second position, the rotation angle of the starboard flanking rudder is the same as the rotation angle of the port flanking rudder.

11. The method of claim 1, wherein the port flanking rudder is rotated from the first position to the second position at a rotation rate, and wherein the starboard flanking rudder is rotated from the first position to the second position at a rotation rate.

12. The method of claim 11, wherein the rotation rate of the port flanking rudder is faster than the rotation rate of the starboard flanking rudder.

13. The method of claim 11, wherein the rotation rate of the starboard flanking rudder is faster than the rotation rate of the port flanking rudder.

14. The method of claim 11, wherein the rotation rate of the port flanking rudder is the same as the rotation rate of the starboard flanking rudder.

15. A method of turning a boat having a planing hull, the method comprising:

spinning a propeller in a direction to move the boat in reverse, the propeller having a diameter;

rotating a port flanking rudder from a first position to a second position about a rotation axis positioned (i) forward of the propeller and (ii) laterally within the diameter of the propeller, the port flanking rudder being positioned beneath a bottom of a planing hull of the boat and on port side of a centerline of the planing hull;

rotating a starboard flanking rudder from a first position to a second position about a rotation axis positioned (i) forward of the propeller and (ii) laterally within the diameter of the propeller, the starboard flanking rudder being positioned beneath a bottom of a planing hull of the boat and on starboard side of a centerline of the planing hull.

16. The method of claim 15, wherein the rotation axis of each of the port flanking rudder and the starboard flanking rudder is positioned forward of the propeller a distance that is less than or equal to three times the propeller diameter.

17. The method of claim 15, wherein the port flanking rudder is rotated from the first position to the second position by rotating the aft edge of the port flanking rudder in a port direction about the rotation axis of the port flanking rudder, and wherein the starboard flanking rudder is rotated from the first position to the second position by rotating the aft edge of the starboard flanking rudder in port direction about the rotation axis of the starboard flanking rudder.

18. The method of claim 17, wherein the first position of each of the port and starboard flanking rudders is a neutral position and the boat is turned to port by rotating the aft edge of each of the port and starboard flanking rudders to port.

19. The method of claim 15, wherein the port flanking rudder is rotated from the first position to the second position by rotating the aft edge of the port flanking rudder in a starboard direction about the rotation axis of the port flanking rudder, and wherein the starboard flanking rudder is rotated from the first position to the second position by rotating the aft edge of the starboard flanking rudder in starboard direction about the rotation axis of the starboard flanking rudder.

20. The method of claim 19, wherein the first position of each of the port and starboard flanking rudders is a neutral position and the boat is turned to starboard by rotating the aft edge of each of the port and starboard flanking rudders to starboard.

* * * * *